US007527072B2

(12) United States Patent
Crnkovich

(10) Patent No.: US 7,527,072 B2
(45) **Date of Patent: *May 5, 2009**

(54) GAS COOK-TOP WITH GLASS (CAPACITIVE) TOUCH CONTROLS AND AUTOMATIC BURNER RE-IGNITION

(75) Inventor: Andrew Crnkovich, Elmhurst, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 136 days.

This patent is subject to a terminal disclaimer.

(21) Appl. No.: 11/564,935

(22) Filed: Nov. 30, 2006

(65) Prior Publication Data

US 2007/0125356 A1 Jun. 7, 2007

Related U.S. Application Data

(60) Provisional application No. 60/741,993, filed on Dec. 2, 2005.

(51) Int. Cl.
*F16K 1/44* (2006.01)

(52) U.S. Cl. ..... 137/625.34; 137/625.28; 251/129.09; 126/39 R; 126/39 G; 126/39 N

(58) Field of Classification Search ..... 126/214 R, 126/39 G, 39 R; 431/12, 27, 66; 137/625.34, 137/625.28; 251/129.09
See application file for complete search history.

(56) References Cited

U.S. PATENT DOCUMENTS 4,997,161 A * 3/1991 Hutchison et al. ..... 251/129.08
5,241,463 A * 8/1993 Lee ..... 700/90
5,310,110 A * 5/1994 Akamatsu et al. ..... 236/20 A
5,924,857 A * 7/1999 Frasnetti et al. ..... 431/6
5,945,929 A * 8/1999 Westra ..... 341/34
5,977,694 A * 11/1999 McGuire ..... 313/110
5,981,916 A * 11/1999 Griffiths et al. ..... 219/492
6,198,080 B1 * 3/2001 Rice et al. ..... 219/506
6,809,301 B1 * 10/2004 McIntyre et al. ..... 219/506
7,022,949 B2 * 4/2006 Shukla ..... 219/483
7,045,748 B2 * 5/2006 Blackson et al. ..... 219/446.1
7,151,968 B2 * 12/2006 Williamson ..... 700/65
2002/0045142 A1 * 4/2002 Repper et al. ..... 431/66
2003/0226560 A1 * 12/2003 Shekarri ..... 126/299 R
2004/0069293 A1 * 4/2004 Steurer ..... 126/39 R
2005/0257785 A1 11/2005 Gama et al.

* cited by examiner

*Primary Examiner*—Kenneth B Rinehart
*Assistant Examiner*—Jorge Pereiro
(74) *Attorney, Agent, or Firm*—Reinhart Boerner Van Deuren P.C.

(57) ABSTRACT

A gas cook-top with glass (capacitive) touch controls and automatic burner re-ignition is provided. The gas cook-top utilizes a variable flow gas control valve that is driven by an electronic controller whose user interface provides a glass capacitive touch interface. Various electronic features including safety lockouts and burner re-ignition are provided, as is relational control of the burner flame. As a user moves their finger along a flame adjust indicator, the electronic control positions the variable flow gas valve to control the flame height of the burner to correspond to the relative position along the indicator selected by the user.

20 Claims, 29 Drawing Sheets

GAS COOK-TOP WITH GLASS (CAPACITIVE) TOUCH CONTROLS AND AUTOMATIC BURNER RE-IGNITION

CROSS-REFERENCE TO RELATED PATENT APPLICATIONS

This patent application claims the benefit of U.S. Provisional Patent Application No. 60/741,993, filed Dec. 2, 2005, the teachings and disclosure of which are hereby incorporated in their entireties by reference thereto.

FIELD OF THE INVENTION

This invention generally relates to gas cook tops, and more particularly to burner flame flow control systems for gas cook tops.

BACKGROUND OF THE INVENTION

Gas cook-tops are valued by homeowners for their superior ability to quickly and precisely control the level of heat. Unfortunately gas levels for cook-tops are typically controlled mechanically by the use of manual rotary valves. This mechanical solution limits the features available to consumers.

Capacitive Touch (Glass) interfaces are becoming very popular with consumers. Such a user interface is only available with electronic controls. By incorporating electronic controls, these interfaces can provide desirable safety features, such as a child safe burner lockout, which consumers have come to expect.

Unfortunately, such safety features are expensive and difficult to accomplish with mechanical controls, which current gas cook tops require to control the flame. Such puts the gas cook top at a competitive disadvantage compared with electric cook tops that can use the capacitive touch interfaces.

There exists, therefore, a need in the art for a gas cook top that incorporates the capacitive touch interface.

Embodiments of the present invention provide such a gas cook top. These and other advantages of the invention, as well as additional inventive features, will be apparent from the description of the invention provided herein.

BRIEF SUMMARY OF THE INVENTION

In view of the above embodiments of the present invention provide a new and improved gas cook-top. More particularly, embodiments of the present invention provide a new and improved gas cook-top that utilizes a capacitive touch control user interface. Even more particularly, embodiments of the present invention provide a new and improved gas cook-top that utilizes electronic capacitive touch controls that provide enhanced electronically controlled features heretofore unavailable for gas cook-tops.

In one embodiment of the present invention, a new variable flow gas valve is incorporated into a gas cook-top to allow the use of electronic controls, such as a glass touch interface, to control the level of the burner flame. The control system also provides additional safety features, such as automatic burner re-ignition if the flame blows out, burner lockout if the burner fails to ignite and a child safety burner lockout feature. These additional safety features improve the safety of the gas cook top and reduces the chances of an accident. Glass-touch controls and flat cook-tops are easier to clean than traditional cook-tops and have superior aesthetic appeal than traditional mechanical interface gas cook-tops.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
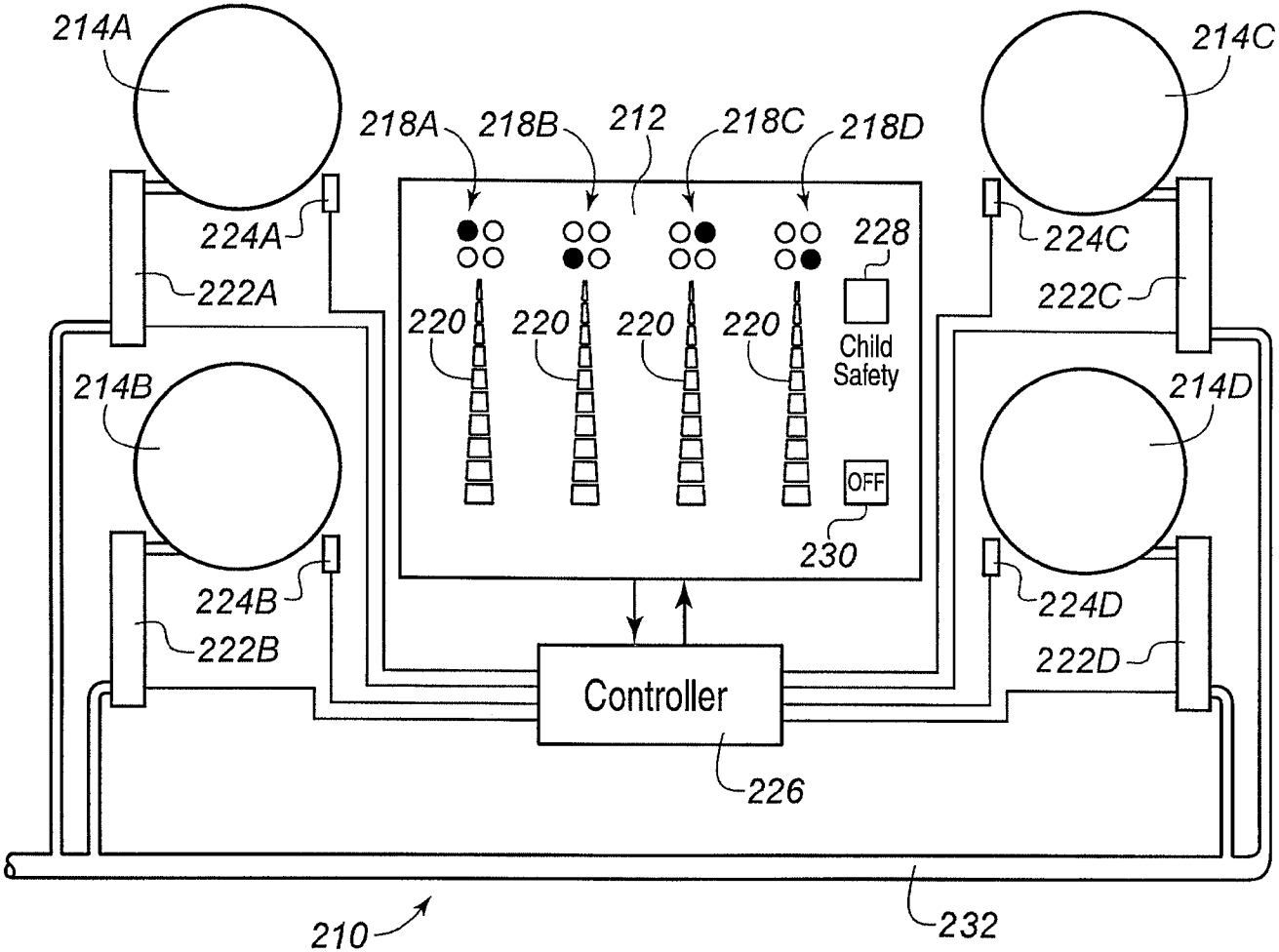
FIG. 1 is a simplified block diagram of an embodiment of the gas cook-top constructed in accordance with the teachings of the present invention.

In one embodiment of the present invention illustrated in FIG. 1, gas cook-top system 210 incorporates variable flow gas valves $\mathbf{222}_{A\text{-}D}$ that enable the utilization of a Capacitive Touch (Glass) interface 212. While one embodiment utilizes glass, other materials may also be used as will be recognized by those skilled in the art. A burner ignition system including a flame sense electrode $\mathbf{224}_{A\text{-}D}$ is utilized to allow the controller 226 to electronically verify the presence of flame at the burners $\mathbf{214}_{A\text{-}D}$. This combination of controls allows the system to have various capabilities.

Figure 2:
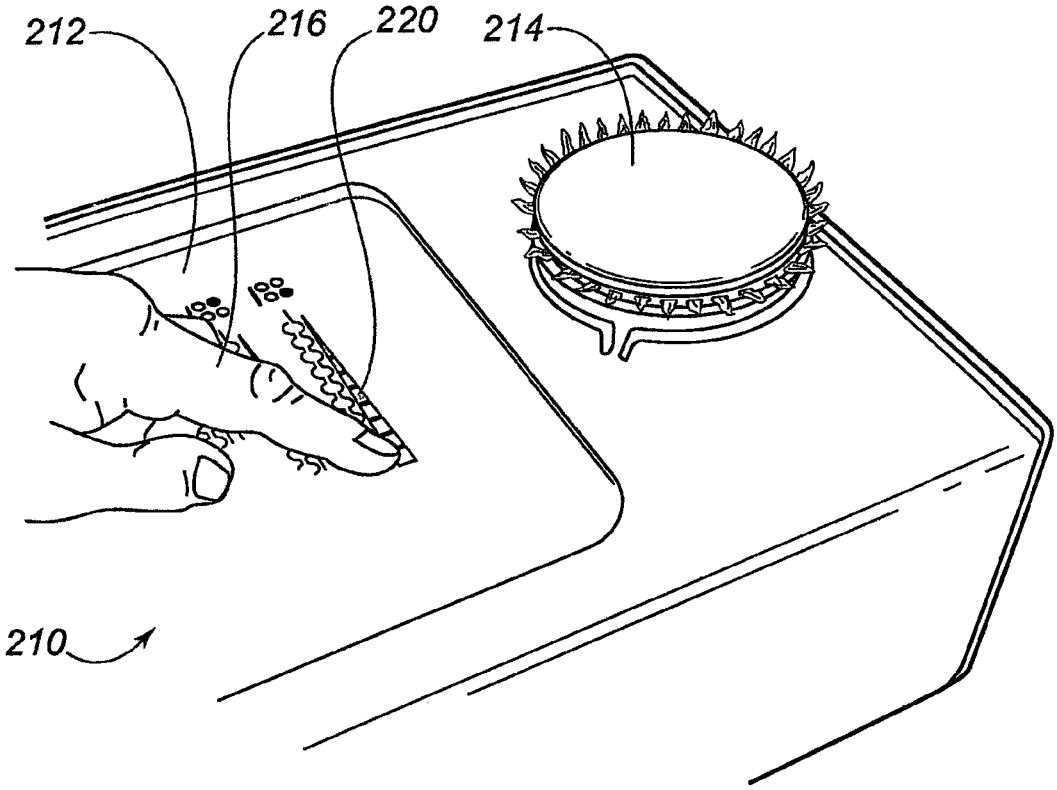
FIG. 2 is a perspective illustration of the gas cook-top of FIG. 1 illustrated in one aspect of its operation.

One such capability is touch control. A consumer can ignite the burner and change heat settings, i.e. flame height, with the touch of a finger 216 as illustrated in FIG. 2 and as will be described more fully below. The system of the present invention also provides in one embodiment an auto re-light feature. The controller 226 will automatically re-ignite the burner 214 if the flame is unintentionally extinguished (e.g. by wind) as sensed by the flame sense electrode 224. Additionally, an embodiment provides a safety burner lockout feature. If the burner 214 does not ignite within a predetermined period, the controller will automatically terminate the gas flow to that burner 214. The controller 226 in one embodiment will allow a manual re-attempt to ignite the burner 214, and in an alternate embodiment will require a purge period to elapse to prevent a build up of gas due to several manual attempts to restart the burner 214. An embodiment of the present invention also provides a child cook-top lockout feature. That is, the cook-top system 210 can be disabled to prevent a child from accidentally activating a burner 14 by having the user select, e.g. touch the child safety lockout icon 228 on the capacitive touch glass interface 212. The system 210 of the present invention, in another embodiment, provides an emergency off icon 230 that when touched by the user, will cause the controller 226 to immediately extinguish all burners $\mathbf{214}_{A\text{-}D}$.

While those skilled in the art will recognize that the particular operating modes and layout of the capacitive touch glass interface 212 of the embodiment of the present invention illustrated in FIG. 1 are not limiting to the scope of the present invention, the following will describe this embodiment to aid in the understanding of this system. The illustrated embodiment includes a burner select icon $\mathbf{218}_{A\text{-}D}$ that is used to enable operation of a particular burner $\mathbf{214}_A$, $\mathbf{214}_B$, $\mathbf{214}_C$ or $\mathbf{214}_D$ on the gas cook-top system 210. The user first selects the desired burner $\mathbf{214}_A$, $\mathbf{214}_B$, $\mathbf{214}_C$ or $\mathbf{214}_D$ by touching the corresponding icon $\mathbf{218}_A$, $\mathbf{218}_B$, $\mathbf{218}_C$ or $\mathbf{218}_D$. Once the controller 226, via capacitive touch interface 212, has detected this operation, the electronic controller 226 will begin to flash the appropriate flame adjust indicator $\mathbf{220}_{A\text{-}D}$ to provide a visual indication to the user that flame at a particular burner $\mathbf{214}_A$, $\mathbf{214}_B$, $\mathbf{214}_C$ or $\mathbf{214}_D$ will soon be forthcoming.

In one embodiment, the user would then select a desired flame height from the flame adjust indicator 220 by touching an appropriate location therealong as illustrated in FIG. 2. Once the controller 226 has detected the user selection along the flame adjust indicator 220 via the capacitive touch glass interface 212, electronic controller 226 positions the appropriate gas valve $\mathbf{222}_A$, $\mathbf{222}_B$, $\mathbf{222}_C$ or $\mathbf{222}_D$ (see FIG. 1) to the appropriate position and initiates the gas ignition sequence. Flame then becomes present at the selected burner $\mathbf{214}_A$, $\mathbf{214}_B$, $\mathbf{214}_C$ or $\mathbf{214}_D$ at the corresponding flame height.

In an alternate embodiment, upon selection of the burner select icon 218, the controller 226 will flash the appropriate flame adjust indicator $\mathbf{220}_{A\text{-}D}$ to provide a visual indication to the user that flame at a particular burner $\mathbf{214}_A$, $\mathbf{214}_B$, $\mathbf{214}_C$ or $\mathbf{214}_D$ will soon be forthcoming, and then will adjust the gas valve 222 to the previous setting for that burner 214, i.e. the last setting prior to that burner 214 being turned off.

To adjust the flame height, the user simply touches a different location along the flame adjust indicator 220 or simply slides their finger 216 along the length of the flame adjust indicator 220 to vary the flame height as desired (see FIG. 2). As the user selects a different flame height, the capacitive touch interface 212 will detect the particular desired flame height and, via the electronic controller 226, will adjust the variable flow gas valve 222 to provide a corresponding amount of flow of gas from the gas supply 232 to smoothly adjust the flame height to the desired amount. As the user slides his or her finger 216 along the length of the flame adjust indicator 220, the electronic controller 226 will correspondingly adjust the variable flow gas valve 222 to adjust the flame height in relation to the movement of the user's finger 216 as detected by the capacitive touch interface 212.

Figure 3:
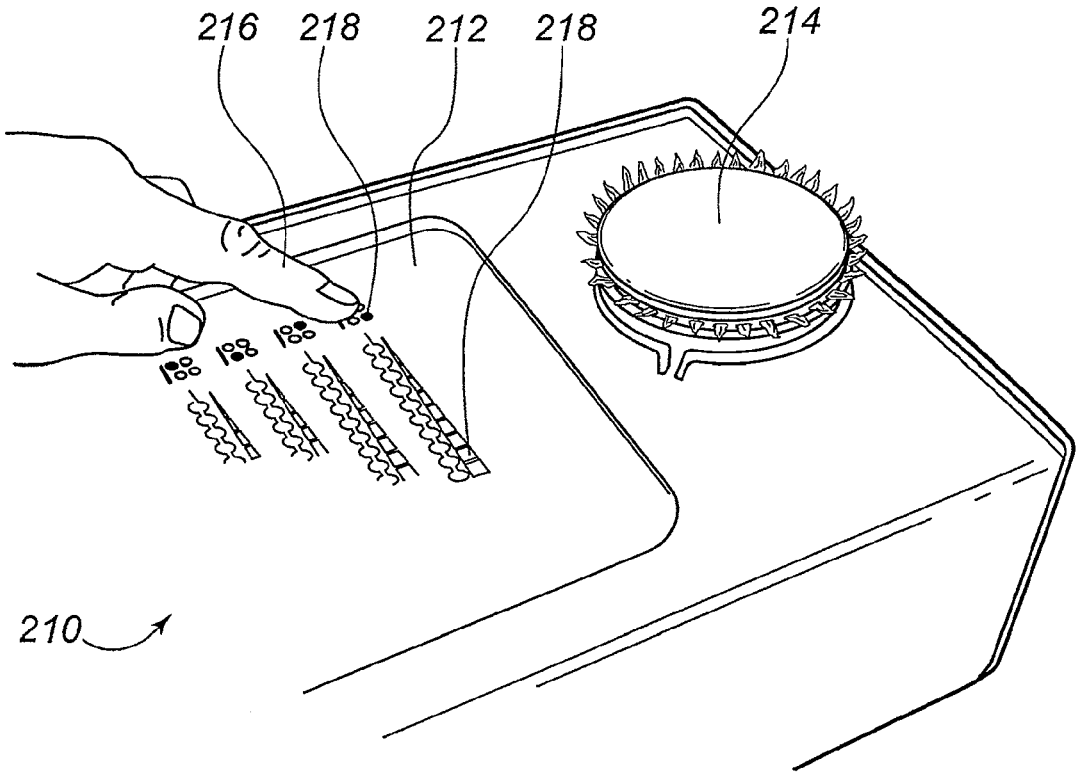
FIG. 3 is a perspective illustration of the gas cook-top of FIG. 1 illustrating a further aspect of operation.

In one embodiment of the present invention, the controller 226 will continuously adjust the flame height at the burner 214 when the user continuously touches the burner select icon 218 as illustrated in FIG. 3. The controller 226 will slowly increase the flame height to the maximum and then, in one embodiment, slowly decrease the flame height to the minimum.

In an alternate embodiment, selection of the icon 218 when the burner 214 is already ignited will result in the controller 226 turning off the burner 214. In this embodiment during operation, if the user wishes to extinguish the flame at a particular burner 214, the user would simply touch the appropriate burner icon 218. Once the capacitive touch interface 212 has detected the user's touch at this icon 218, electronic controller 226 will operate the variable flow gas valve 222 to terminate flow of gas and extinguish the flame at that burner 214.

Programmed operation of the flame height is also available via the electronic controller 226. While not illustrated in FIG. 1, other burner control icons, buttons, knobs, etc. are provided in alternate embodiments that relate to preset flame heights or gaseous fuel flow to the burner, e.g. simmer, low, medium, high, particular temperature settings, keep warm, gentle, delicate, etc. The controller 226 drives the variable flow gas valves 222 to the corresponding presetting of gas flow when one of these icons are selected.

In one embodiment, the variable flow gas valves $\mathbf{222}_A$, $\mathbf{222}_B$, $\mathbf{222}_c$ or $\mathbf{222}_D$ may be the variable flow gas valves described in PCT International Application No. PCT/NZ2005/000135 entitled "Variable Flow Valve", and in copending U.S. patent application Ser. No. 11/507,107 entitled "Variable Flow Valve," the teachings and disclosure of which are hereby incorporated by their entireties by reference thereto, with particular portions thereof reproduced below.

The present invention is applicable generally to the control of fluid flow including, by way of example only, gas cooking appliances such as cook-tops, barbecues and ovens, digitally controlled fluid flow for home and industrial appliances (washing machines, dishwashers, fire places, air and water heating, air conditioning) and transport vehicle fuel systems, water supply, for dosing and mixing fluids, etc.

Figure 4:
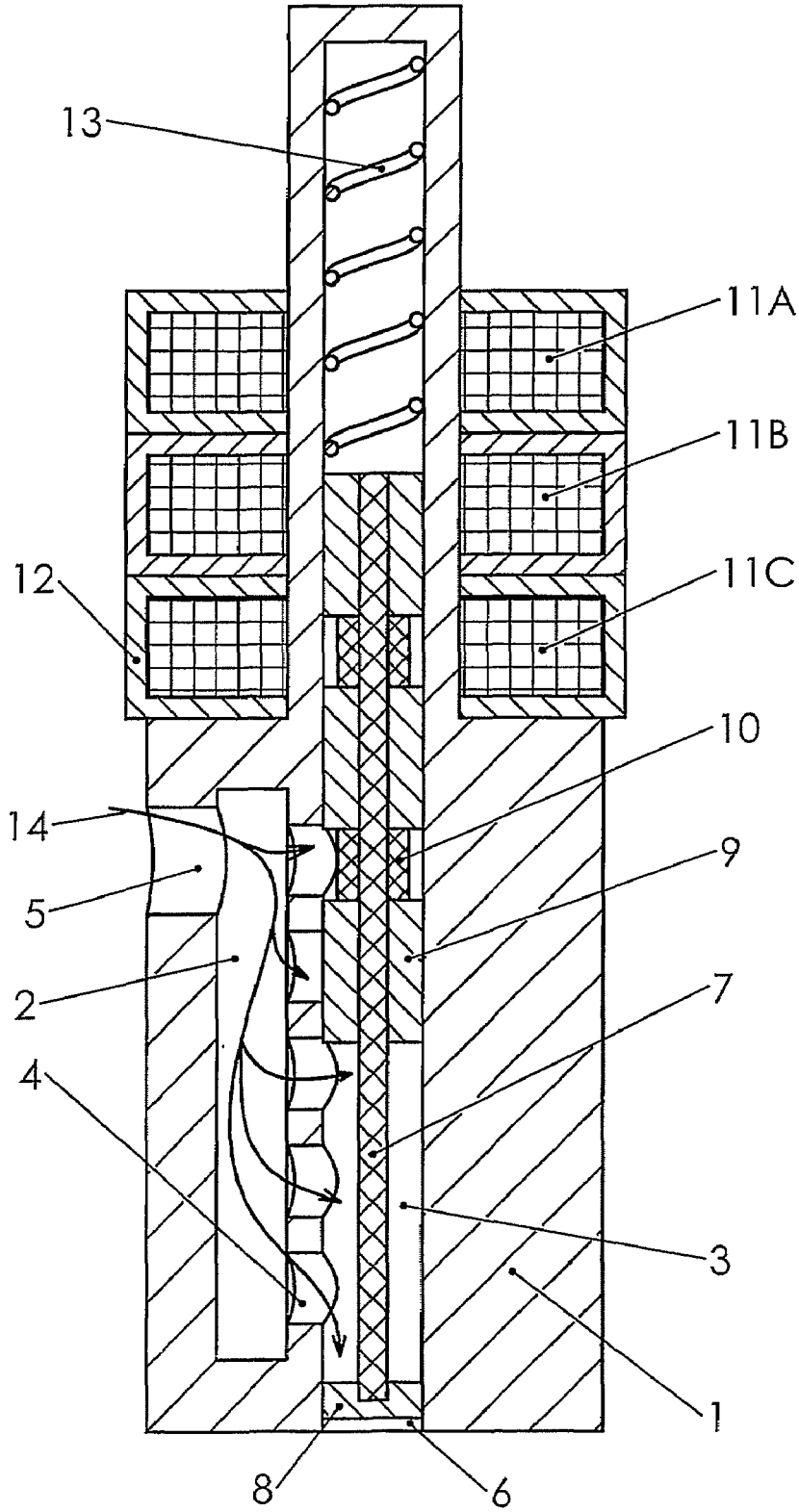
FIG. 4 shows a cross-sectional view of a valve of the present invention in the fully closed position.

In a first embodiment illustrated in FIG. 4, a variable flow valve includes a linear stepper motor. In the preferred embodiment the variable valve includes a housing 1, closed at one end and open at the other, the open end forming an outlet 6. It should be noted that the valve can be used in any orientation. However, for the purposes of this description, the closed end will be described as at the top of the valve, with the open end at the bottom of the valve housing 1. Outlet 6 is the outlet point for gases or other fluids flowing through the valve, and can be fitted with any suitable attachment means or connector. Towards the closed end, the housing 1 is surrounded by at least two and preferably three magnetic field generators 11A, 11B, 11C arranged linearly along part of the length of the housing 1. Preferably the magnetic field generators each surround the housing, with each coil 11 equally spaced from its neighbors. Each coil 11 is preferably surrounded by a core 12 preferably built from iron laminations, communally referred to as a cage. Each coil may have leads (not shown) that are connected to a power supply. Each of coils 11A, 11B, and 11C can be individually energized by the power supply under control of a controller according to a switching sequence. Preferred sequences control will be described later.

Towards the other end of the housing 1, inlets 4 pass from an outer part of the housing 1 to the inside surface of a bore. The inlets 4 are axially spaced along at least part of the length of the housing 1. In the preferred embodiment, there are five inlets 4A-E, each spaced at equal distances from its neighbors.

If differing flow profiles are required, the profiles can be generated by having differing cross sectional areas of the inlets.

The lower part of the housing 1 is surrounded by a sleeve portion 16. The sleeve fits flush with the outside surface of the housing 1, except where the inlets 4 pass into and out of the housing 1. There the sleeve is spaced slightly away from the external surface of the housing 1 to form a chamber 2. The chamber is sealed, apart from the inlets 4 and a primary inlet 5. The primary or master inlet 5 serves as the main entry point for gases or other fluid entering the valve. The inlet 5 may be fitted with any suitable attachment or connector, for connecting the inlet 5 to a gas or fluid reservoir.

Within the housing 1 there is a valve member or piston. The valve member includes a plunger 8 attached to the end of a valve stem 7. The plunger 8 lies towards the open end of housing 1.

Plunger 8 can be made from any suitable material or combination of materials which allow the edge or edge surfaces of plunger 8 to lie flush with or close to the inside surface of housing 1 and form a substantial seal between the periphery of plunger 8 and housing 1. The plunger may also incorporate a sealing means such as rubber o-ring 23 shown in FIG. 8.

At the other end of valve stem 7 are at least two magnetic elements 9. These elements be made from any magnetic material.

In this embodiment, the number of magnetic elements corresponds to the number of coils 11. Each of the three magnetic elements 9A, 9B, 9C shown in these embodiments are separated from each other by a non-magnetic insert 10 added to the stem 7 between the magnetic elements 9. These are equally spaced where three or more magnetic elements 9 are used.

The spacing of the magnetic elements corresponds to the spacing of the coils 11 along the outside of the housing 1 so that when one of the magnetic element segments is entirely within the coils, one of the neighboring segments will be approximately halfway between the coils, as shown for example in any of FIG. 6B, 6C, 6D, 6E, 6F, 6G or 6H. When a magnetic element is partially, but not entirely within a coil as arranged in this embodiment the energization of the coil will create a significant attractive force pulling the magnetic element toward its centre. For a drive motor where the linear of movement is equal to the axial coil spacing, the coil to magnetic element spacing ratio is determined by the formula (1):

$$L_{Spacing} = \frac{1}{N_{Sets}} \cdot \frac{L_{MagElements}}{N_{Coils} - 1}; \tag{1}$$

where $L_{Spacing}$ is the spacing between magnetic elements, $L_{MagElements}$ is the axial length of the magnetic elements, $N_{Coils}$ is the number of coils and $N_{Sets}$ is the number of simultaneously energized coils.

This staggered spacing allows the opening and closing drive sequence of the valve motor to be similar to that of a linear stepper motor.

The length of the magnetic elements 9 also correspond approximately with the length of the coils 11. Therefore each of the coils 11 and segments 9 are approximately the same length.

A spring 13 is located between the closed end of the housing 1 and the end of the valve stem 7. The spring 13, housing 1, and valve stem 7 are all dimensioned relative to one another such that in the neutral position (that is, with power to all of the coils turned off) the plunger 8 will block and seal the outlet 6. Spring 13 is a preferred option for urging the valve member toward the seal, but any suitable biasing agent would be used, including gravity.

Figure 5:
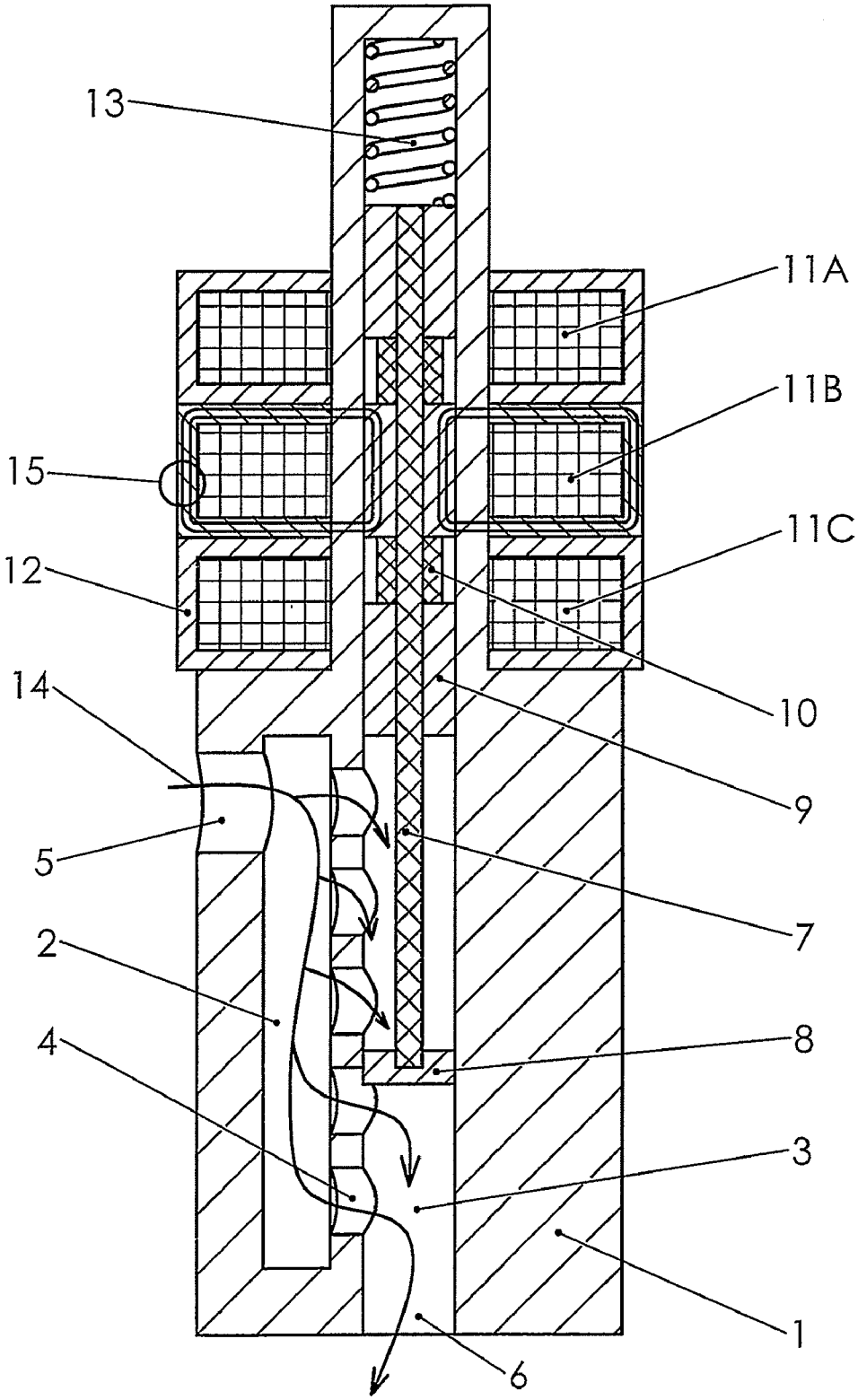
FIG. 5 shows a cross-sectional view of the valve of the FIG. 4 with the valve stem partially raised within the housing of the valve.
Figure 6:
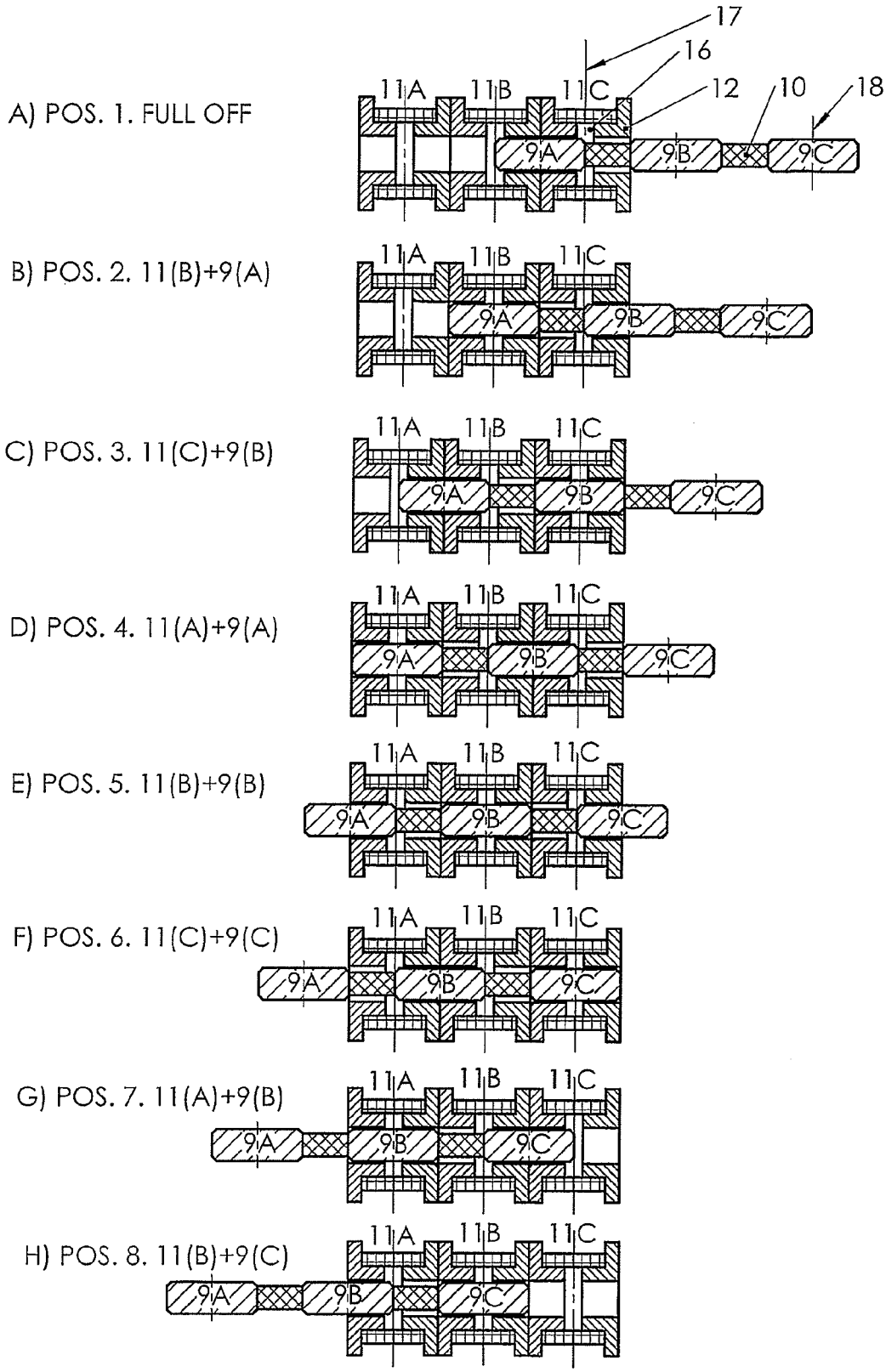
FIGS. 6A-H show a cross-sectional view of the coil activation sequence of the valve of FIG. 4, to open the valve from a fully closed position to fully open.

The operation of the variable flow valve will now be described in more detail with reference to FIGS. 4 through 6. Gas or other fluid flows into chamber 2 through master inlet 5, as shown by arrows 14. As previously described, in the "neutral" or power off position, plunger 8 blocks outlet 6 the valve member is urged to this position by spring 13. The valve member is urged to this position by spring 13. FIG. 6A shows the off position where magnetic element 9A is located so that it lies approximately halfway between coil 11B and 11C. Magnetic element 9B is located just outside coil 11C. The coil 11C can exert no significant force on the element 9B at this location.

When the valve is to be opened, coil 11B is activated first in the sequence. Activation of coil 11B draws magnetic element 9A up the housing 1, towards the closed end, so that magnetic element 9A lies substantially within the coil 11B when the magnetic centre 18 of the magnetic element 9A coincides with magnetic centre 17 of coil 11B as shown in FIG. 6B. As magnetic element 9A is drawn into coils 11B valve stem 7 and thus plunger 8 are drawn up the shaft past inlet 4A. A flow path is thus created between inlet 4A and outlet 6. This allows a gas or other fluid to flow between inlet 5 and outlet 6, via chamber 2 and inlet 4A.

The flow is increased by moving the valve member 8 further up the housing 1. This movement is achieved in the following manner: when coil 11C is activated, the power to coil 11B is simultaneously turned off. The activation of coil 11C pulls magnetic element 9B entirely within coil 11C, pulling valve stem 7 further up housing 1. As coil 11B has been deactivated there is no resistance to the movement of magnetic element 9A through and out of coil 11B. The activation and deactivation of coils is either instantaneous or with some energization cross-over.

This moves the valve member to position 3 in FIG. 6. In this position at least inlet 4A is fully exposed providing a direct flow path between inlet 5 and outlet 6 via at least inlet 4A.

To increase the flow, the valve member is moved further up housing 1. This is achieved by turning on the power to magnetic coil 11A and simultaneously deactivating the power to coil 11C. Magnetic element 9A is pulled entirely within coil 11A from its position halfway between coils 11A and 11B. Thus valve member moves further up housing 1.

The magnetic elements 9A, 9B, 9C and coils 11A, 11B, 11C are now located as shown in FIG. 6D. In order to increase the flow further, valve member is moved further up the housing 1. This is achieved by turning off the power to coil 11A, and turning on the power to coil 11B. The activation of coil 11B pulls magnetic element 9B entirely within coil 11B from its position halfway between coil 11B and coil 11C. The deactivation of coil 11A allows magnetic element 9A to move out of its position within coil 11A into the position shown in FIG. 6E, FIG. 5 shows that inlets 4A and 4B are now both fully exposed, allowing an increased flow.

The valve member is moved still further up the housing 1 to further increase the flow by turning off power to coil 11B and turns on power to coil 11C. This pulls magnetic element 9C entirely within coil 11C, and allows magnetic element 9B to move out of coil 11B, thus moving the valve member further up the housing 1. Then, power to coil 11A is activated at the same time as power to coil 11C is deactivated. Magnetic element 9B is pulled entirely within coil 11A, and allows magnetic element 9C to move out of coil 11C. This position is shown in FIG. 6G. The next step pulls the valve into the fully open position. In this step coil 11B is activated at the same time as coil 11A is deactivated. This pulls magnetic element 9C entirely within coil 11B. At this point spring 13 is compressed or close to fully compressed against the closed end of housing 1 and all of inlets 4A, 4B, 4C, 4D and 4E are exposed, allowing maximum flow between inlet 14 and outlet 6.

The switching sequence described above is usually reversed to gradually close the valve. However when power to all the coils 11 is deactivated, the spring 13 will return the valve stem 7 to the neutral or closed position automatically. This has the advantage of cutting flow through the valve in the event of a power failure. In case of a non horizontal installation of the valve when the outlet 6 is placed lower than any other part of the piston housing 3 then the shutoff force can be provided by the weight of the moving parts such as stem 7, piston 8, magnetic elements 9 and spacers 10. Stem 7 can also be additionally urged toward the outlet by the fluid pressure behind the piston 8.

If required, valve shut off can also be performed by means of a reset button (not shown) which activates the closing sequence. It will be clear from the above description that different flow profiles and rates of flow can be achieved by varying the elements, as would be obvious to one skilled in the art. For example, varying the number of coils 11, or magnetic elements a number of inlets 4 and the size of each of the inlets 4 will all change the flow rate profile. Any or all of these integers could be varied to create the desired flow metering profile and resolution.

Figure 7:
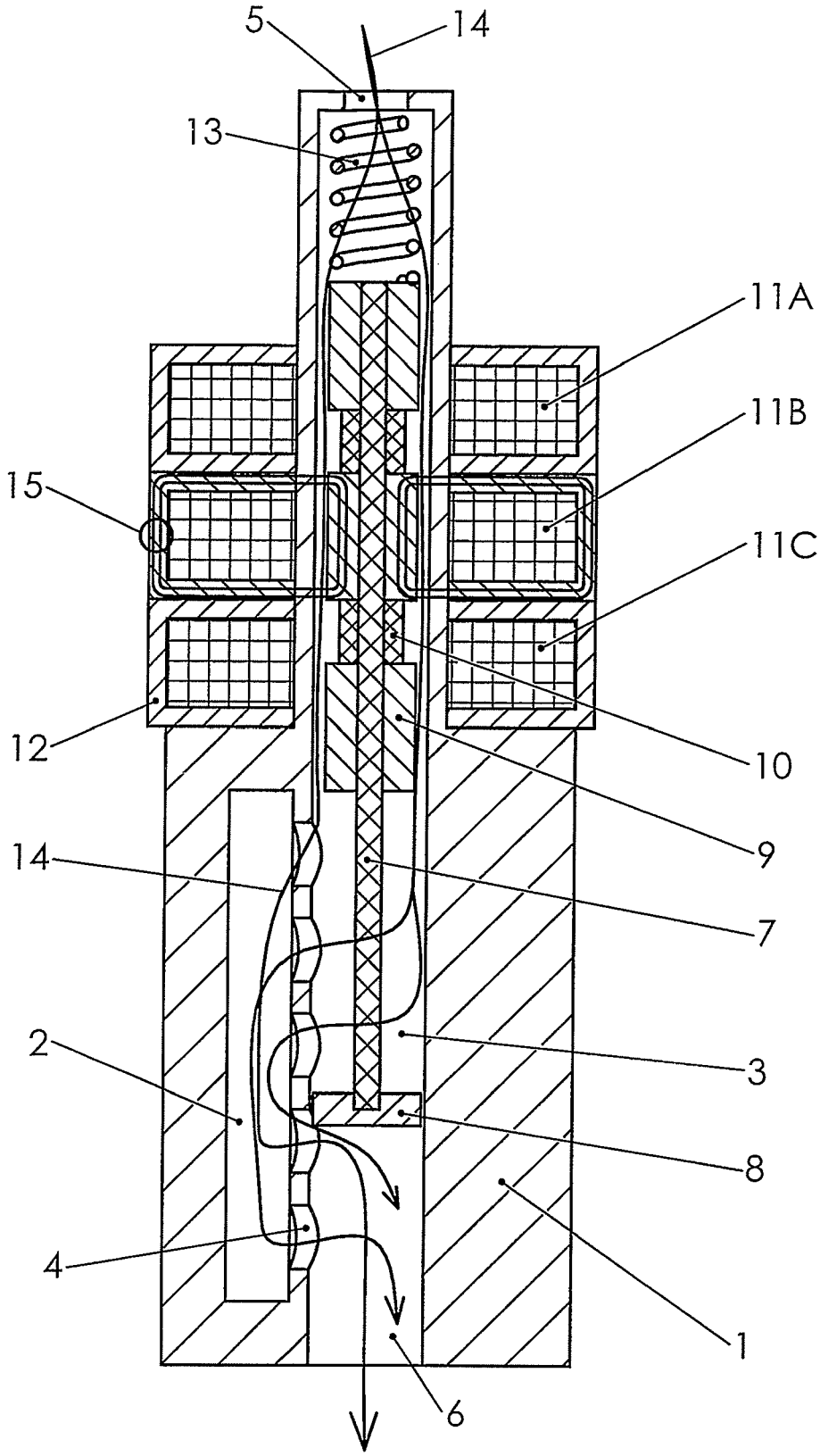
FIG. 7 shows a cross-sectional view of an alternative embodiment of the valve of the present invention.

In an alternative embodiment illustrated in FIG. 7 master inlet 5 is located at the top end of the housing 1. Gas or other fluid thus enters housing 1 at the top end, and flows around the spring 13. In this embodiment magnetic elements 9A, 9B and 9C have a cross-sectional profile which is substantially less than the cross-sectional profile of the inside of housing 1, so that the gas or other fluid may flow along the length of the housing 1, between the inner surface and magnetic elements 9A, 9B and 9C, the flow being shown by arrows 14. As the gas or fluid reaches the lower portion of the valve, it flows out of housing 1 into cavity 2 via one or more of inlets 4E, 4D, 4C, 4B and 4A. In the fully closed position all of these inlets are available for this use. As the valve shaft 7 is moved up the housing 1, using the same or a similar activation sequence as has already been described for the first embodiment, the movement of piston 8 up the housing 1 exposes, in sequence, inlet 4A, 4B, 4C and so on, creating a flow path between these inlets and outlet 6. The flow path is thus created, where the gas or fluid flows in through inlet 5, down the housing 1 through at least inlet 4E into chamber 2 then out of at least inlet 4A and out of outlet 6. This embodiment has at least two possible advantages over the first embodiment: a valve closed position can be created with the spring 13 in a fully uncompressed position with piston 8 closing off outlet 6. A second closed position can also be created with the spring 13 in a fully compressed position with piston 8 blocking the flow 14 of gases or other fluid down the housing 1, and stopping gases from entering chamber 2 through any of inlets 4A-E. With this embodiment quite a different flow profile is created when using the same activation sequence, due to the flow passing through two complementary subsets of the openings.

Figure 8:
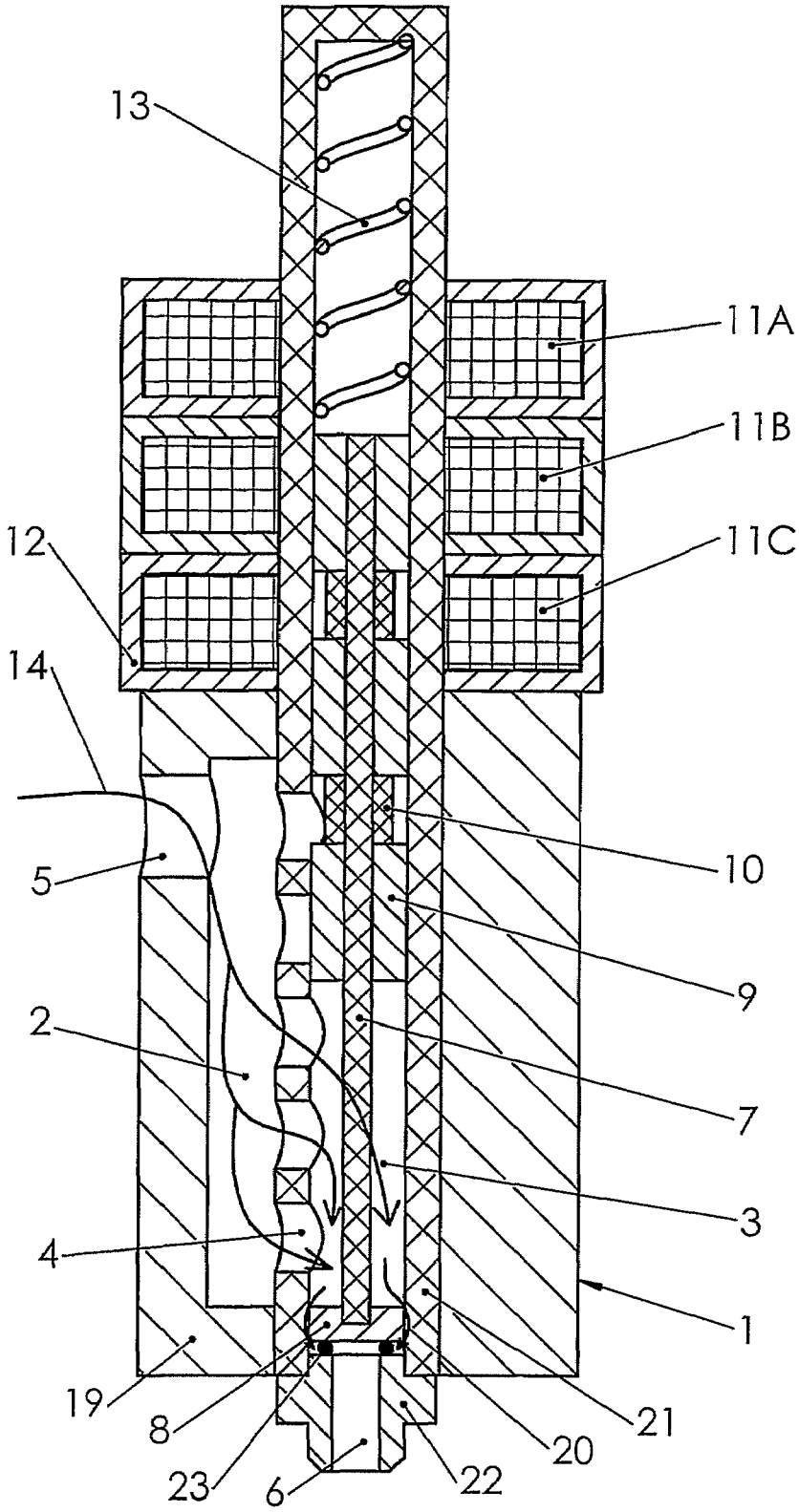
FIG. 8 shows a cross-sectional view of a valve of the present invention with the additional safety sealing.

Another embodiment illustrated in FIG. 8 has an outlet fitting 22 mounted into the outlet 6 with a seal such as a rubber o-ring 23 incorporated to prevent any bypass leakage 20. In this embodiment the housing 1 includes two parts, a hollow part 19 and a piston housing 21. This embodiment provides a production advantage for making the housing.

Figure 9:
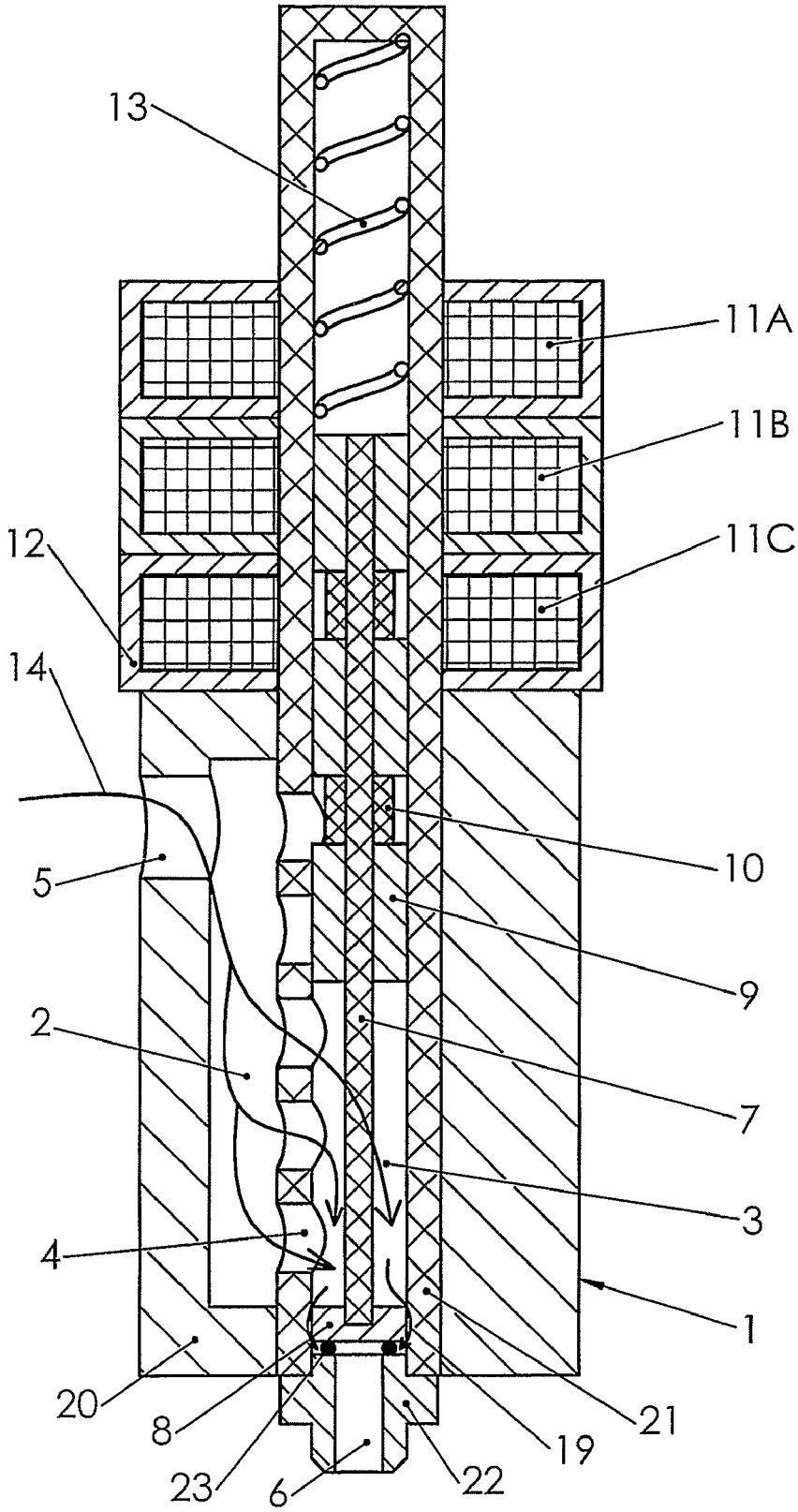
FIG. 9 shows a cross-sectional view of a valve of the present invention with two coils energized together.

To reduce the power consumed by the actuator coils 11 and retain the pull force of the actuator, or to increase the force, the actuator may have more than one set of coils simultaneously energized. Such an embodiment is illustrated in FIG. 9 where two coils 11 are simultaneously energized creating magnetic fields that attract magnetic elements 9. If one coil for example has 1000 turns and is connected to a 100 VDC power supply where the current through the coil is 0.1 A, then the coil consumes 10 W of electrical power and generates a MMF (Magnetic Moving Force) equal to 100 [Amp*Turns]. By ignoring the saturation of magnetic elements 9 we can assume that the MMF is proportional to the pull force of the actuator. To increase the MMF without changing the number of turns and type of winding wire, it is possible to increase the current which requires an increase in voltage. Doubling the voltage (to 200V instead of 100 V) would double the current (0.2 instead of 0.1) and double the MMF (200 Amp*Turns instead of 100 Amp*Turns). However this quadruples the consumed power (40 W instead of 10 W). However by instead this using two similar coils at 100 V and 0.1 Amps we can obtain double MMF consuming only 20 W.

Figure 10:
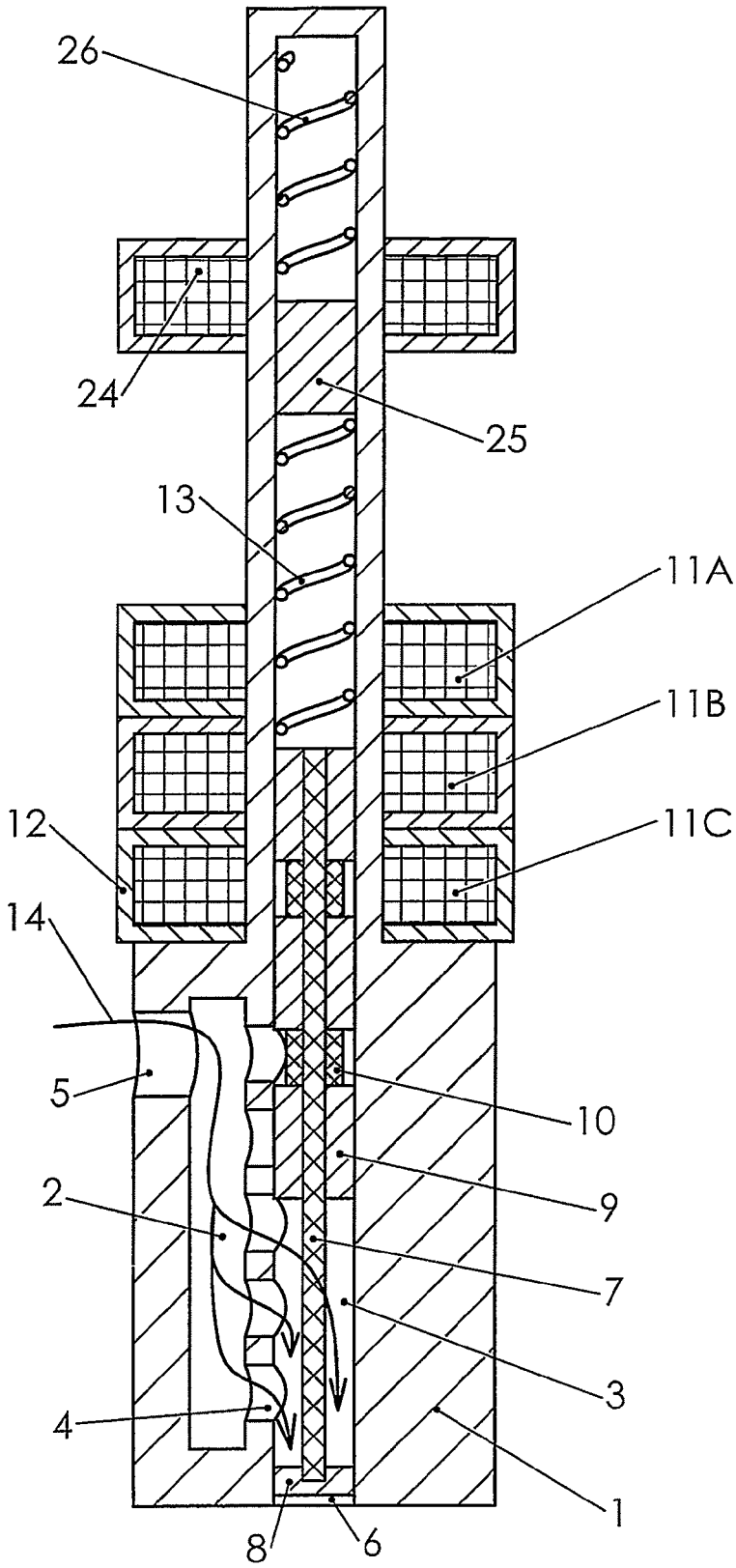
FIG. 10 shows a cross-sectional view of a valve of the present invention with an additional coil, magnetic element and biasing means in the fully closed position.
Figure 11:
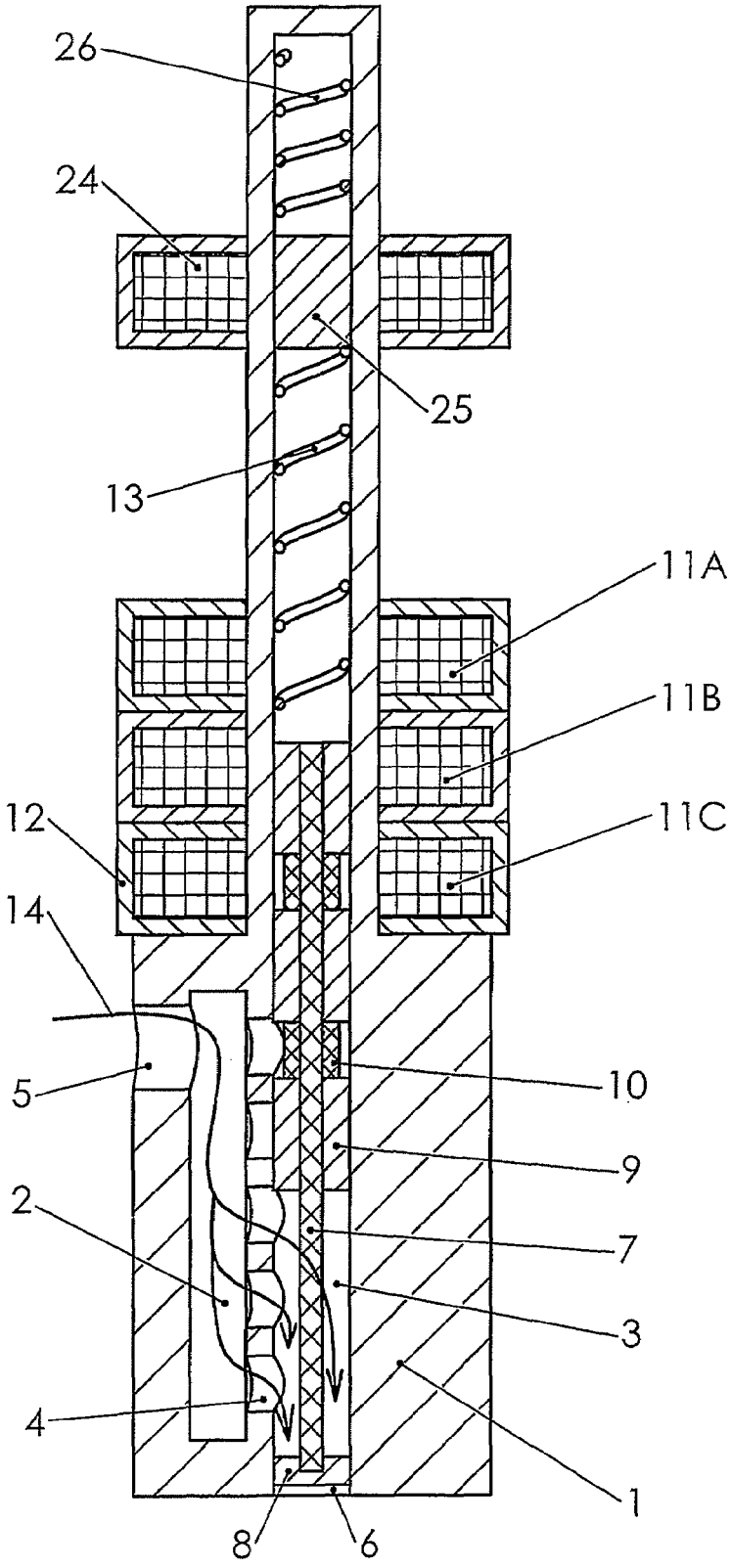
FIG. 11 shows a cross-sectional view of the valve of FIG. 10 with the additional coil energized, and additional biasing means compressed.

A further embodiment is illustrated in FIG. 10. In this additional embodiment coil 24 interacts with additional magnetic element 25. A secondary biasing means, in the form of spring 26, is located between the additional magnetic element 25 and the closed end of the housing 1. The first spring 13 is located between the shaft 7 and the additional magnetic element 25. When the additional coil 24 is energized as illustrated in FIG. 11, the additional magnetic element moves within coil 24 thus increasing the working area for spring 13, reducing the force required to move the shaft which means less reduced MMF and power to the coils 11.

Figure 12:
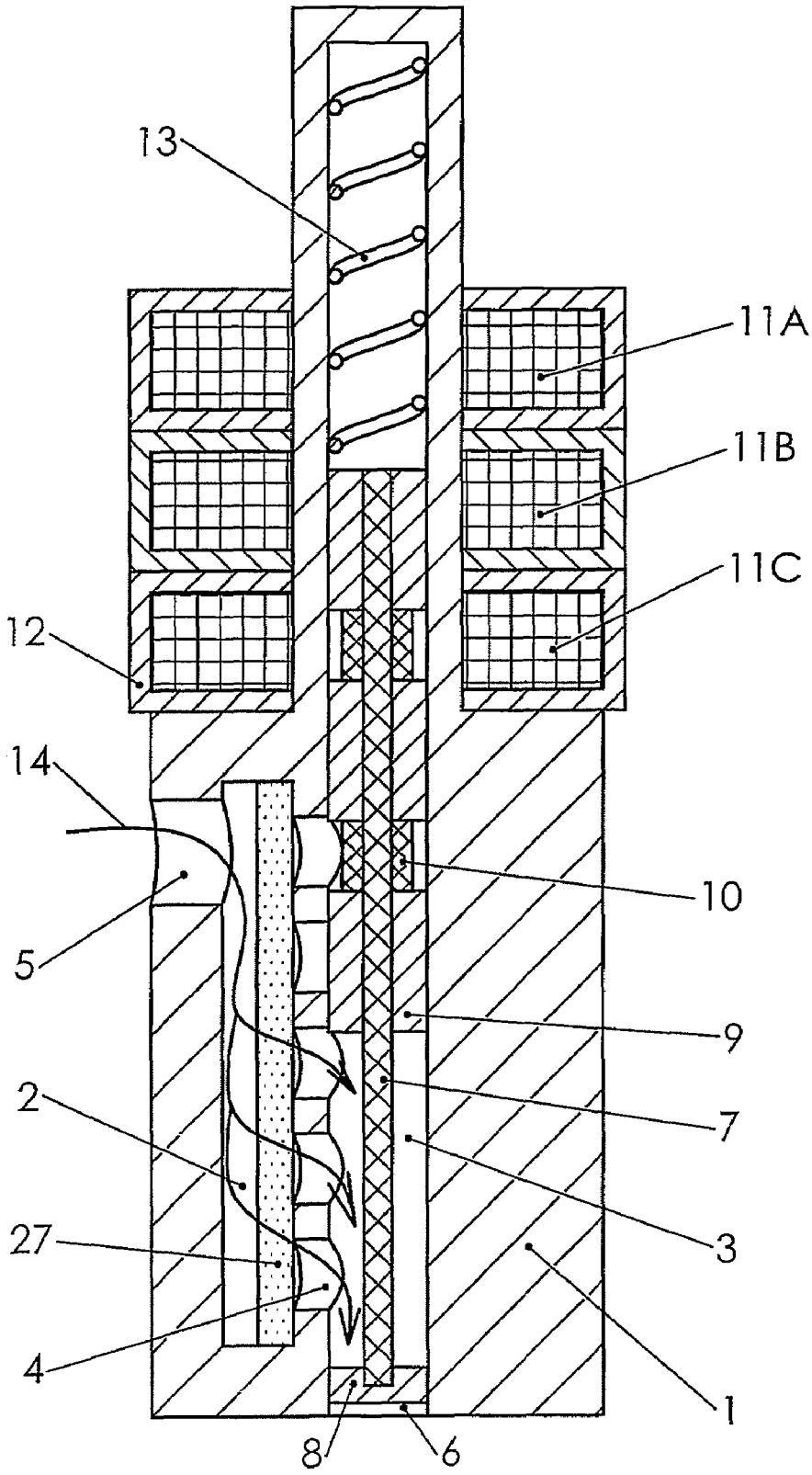
FIG. 12 shows a cross-sectional view of a valve of the present invention with a gas filter between the inlet and apertures.

A further embodiment is illustrated in FIG. 12. In this embodiment the inlets 4 are separated from the master inlet 5 by a filter 27 to prevent the inlets 4 from being clogged The embodiment illustrated in FIG. 13 has a flow restricting insertion 28 between the master inlet 5 and inlets 4. A reduction in cross sectional area of the insertion inlets 29 results from the overlapping of the inlets 4 by the inlets 29. This restricts the fluid flow to the valve. In the position of the restricting insertion 28 is adjustable so the same valve can be used to reduce different master flow rates to match a maximum or safe flow rate specified for an appliance.

Figure 14:
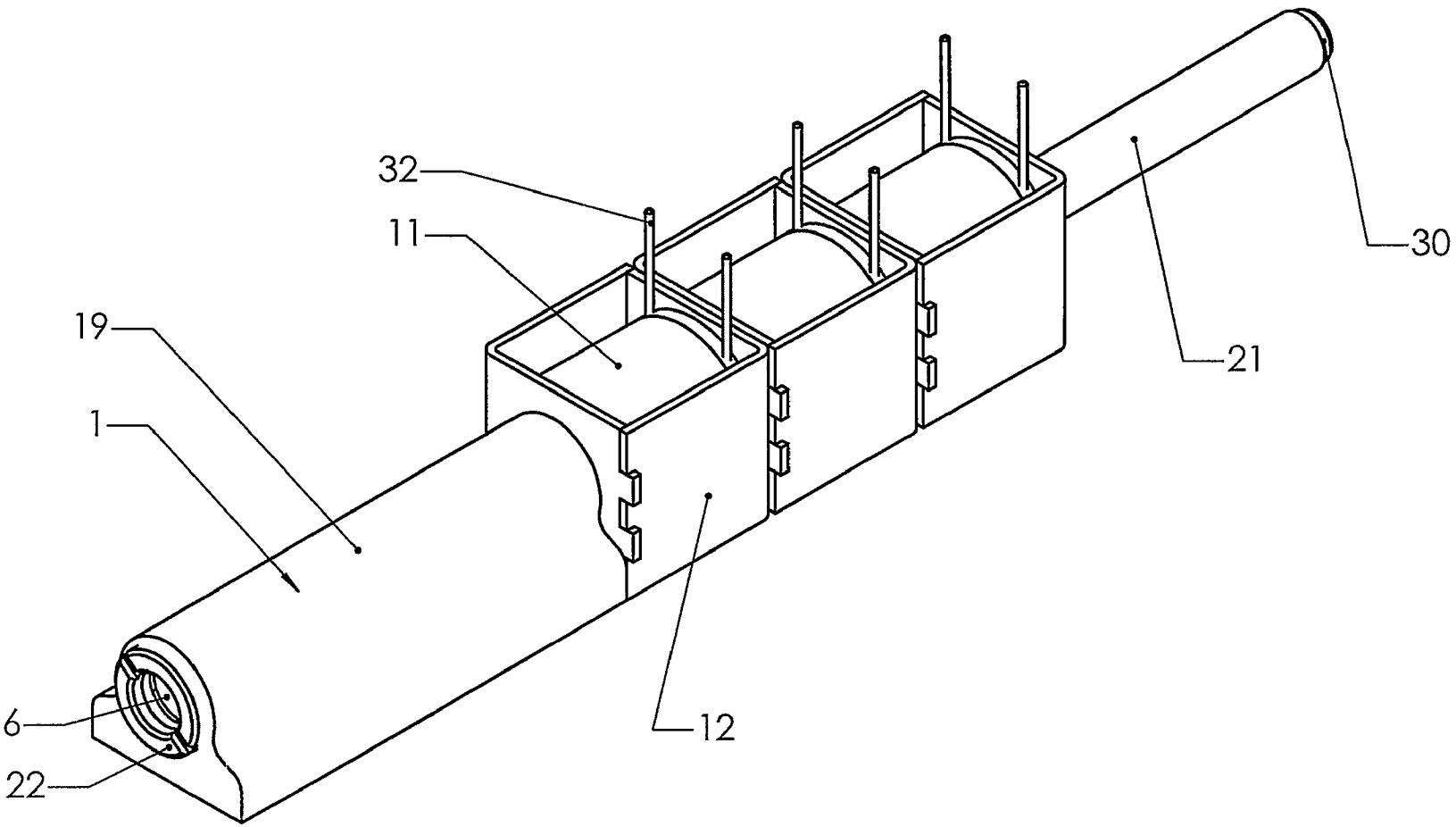
FIG. 14 shows an isometric view of a valve according to another embodiment the present invention.
Figure 15:
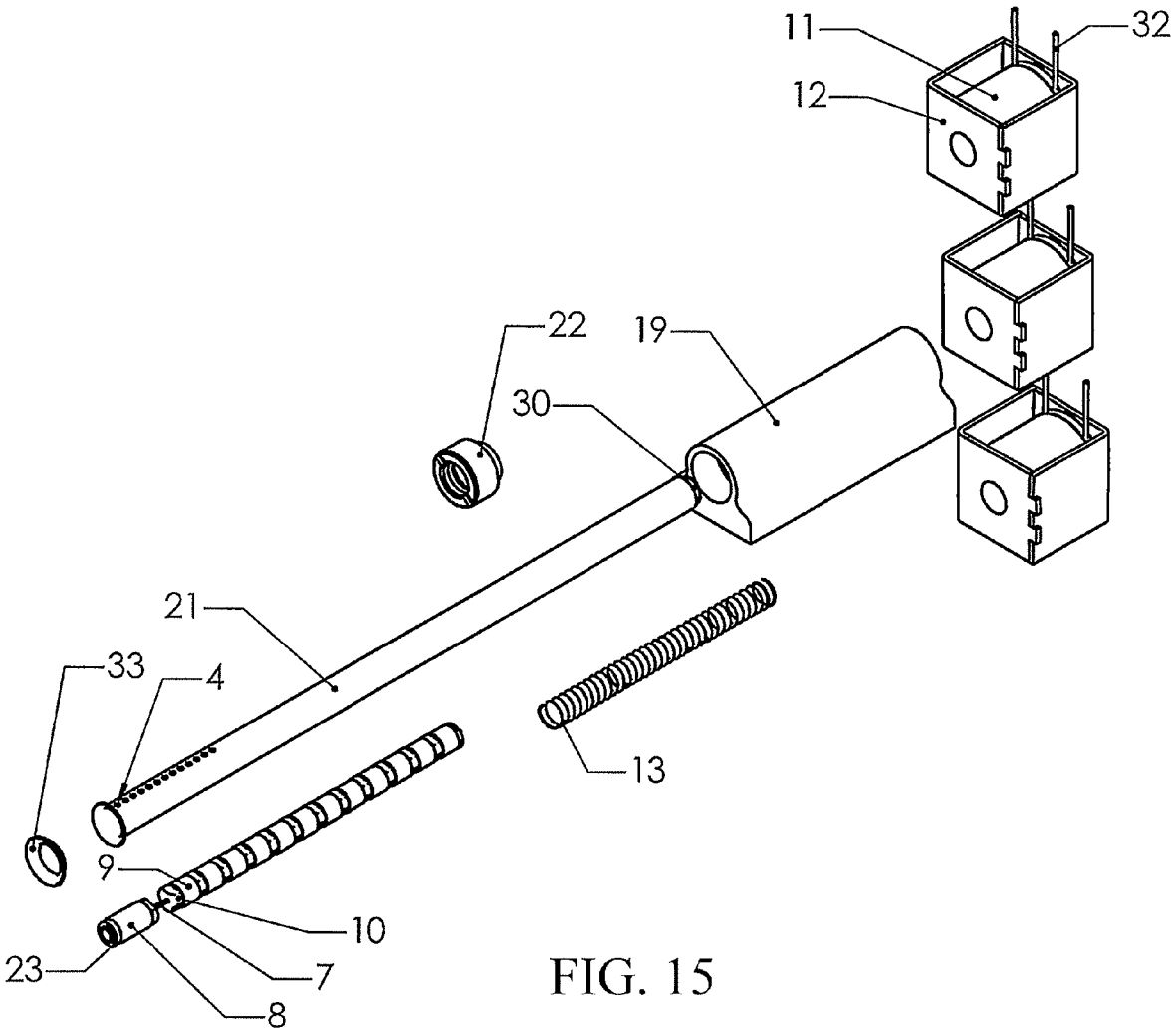
FIG. 15 shows an isometric exploded view of the valve of FIG. 14.
Figure 16:
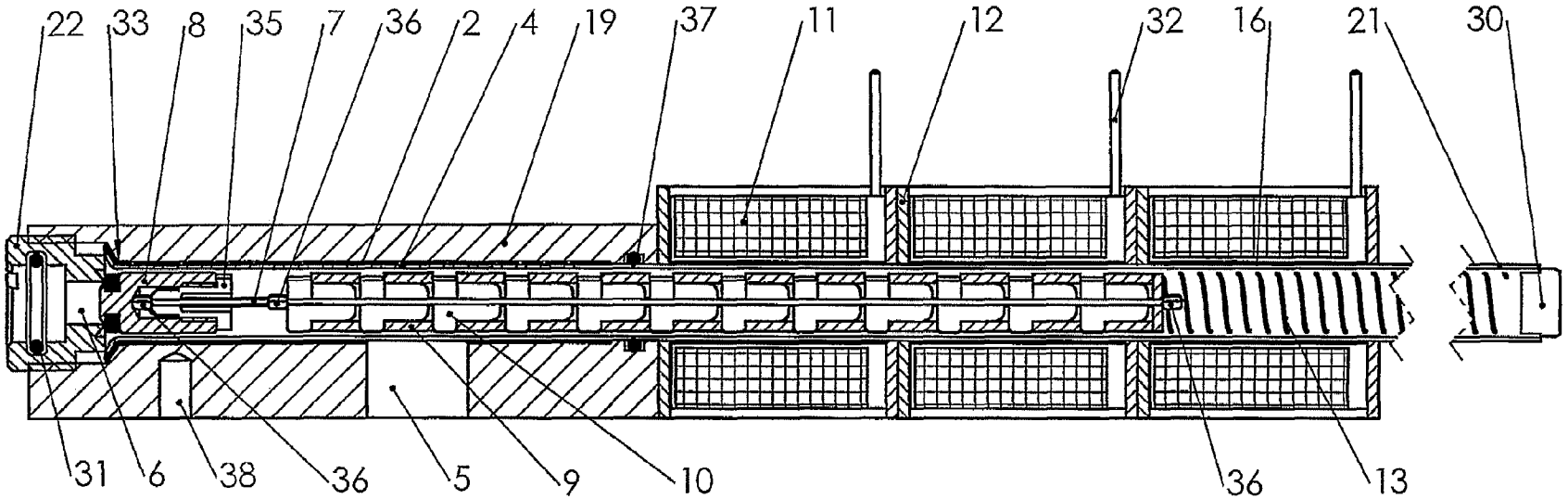
FIG. 16 shows a cross sectional view of the valve of FIG. 14.

FIGS. 14 to 16 show a working prototype of the variable flow valve where items not shown before are: a cap 30 sealing the piston housing 21; a sealing o-ring 31 to seal the connection inside the tube and prevent leakage to the atmosphere; coil terminals 32 to connect the coil windings to the power supply; a seal 33 to prevent fluid leakage from chamber 2 to the outlet or atmosphere by bypassing the piston housing 3. The material of the seal depends on the type of fluid metered by the valve. The working prototype used silicone rubber; screw 35 for mounting the valve member 7 to the piston 8; crimps 36 on the valve member 7 to tighten it to the piston 8 by screw 35. This also prevents the position of the magnetic elements 9 and spacers 10 from moving; a sealing o-ring 37 is used to prevent any fluid leaking between the hollow part 19 of the body 1 and the piston housing 21; an aperture 38 for accepting a screw provides a mounting means for the device inside an appliance.

This prototype embodiment has twelve magnetic elements 9 mounted along the length of the valve member 7. The extra magnetic elements allow for a finer motor step resolution than the embodiment shown in FIGS. 4-13.

There are a series of holes 4 shown in the valve wall. Each of these holes increases the total cross sectional area of the flow path seen by the gas or fluid when exposed. In this embodiment each hole is sequentially exposed as the piston stem 7 is raised by the motor. The rate of change in the flow path cross sectional area can be tailored by predefining the diameter of each inlet hole 4 in the sequence. In this way, flow profiles can be designed depending on the particular appliance or application.

Each magnetic element 9 is fixed onto the valve member 7 with a separation calculated by formula (1). The magnetic elements 9 are approximately equal in diameter to the of the piston housing 21 diameter. There is a small gap between the sides of the magnetic elements and the cylinder walls. This allows some gas or fluid to flow between the surfaces at a fraction of the master flow rate.

The first two steps of the linear stepper motor raise the valve member 8 such that the seal formed beneath it and outlet 6 is broken, without exposing an inlet hole 4. These first two motor steps cause a reduction in the cross sectional area of the flow path seen by the gas or fluid between the valve member 8 and the piston housing 21, and is known as "leakage flow." This leakage flow precedes the rate of flow obtained by the exposure of the first inlet hole.

A spring connects between the top of the piston stem and the top of the cylinder housing. The spring biases the piston shaft toward the bottom of the housing. If there is no power supplied to the electromagnets then the spring will force the piston shaft down, closing the valve. This feature is advantageous in the event of a power failure or a warning from another sensor which may require a sudden shutdown. The force of the spring is less than the electromotive force of the electromagnets, and greater than the gravitational force from the weight of the piston.

Figure 17:
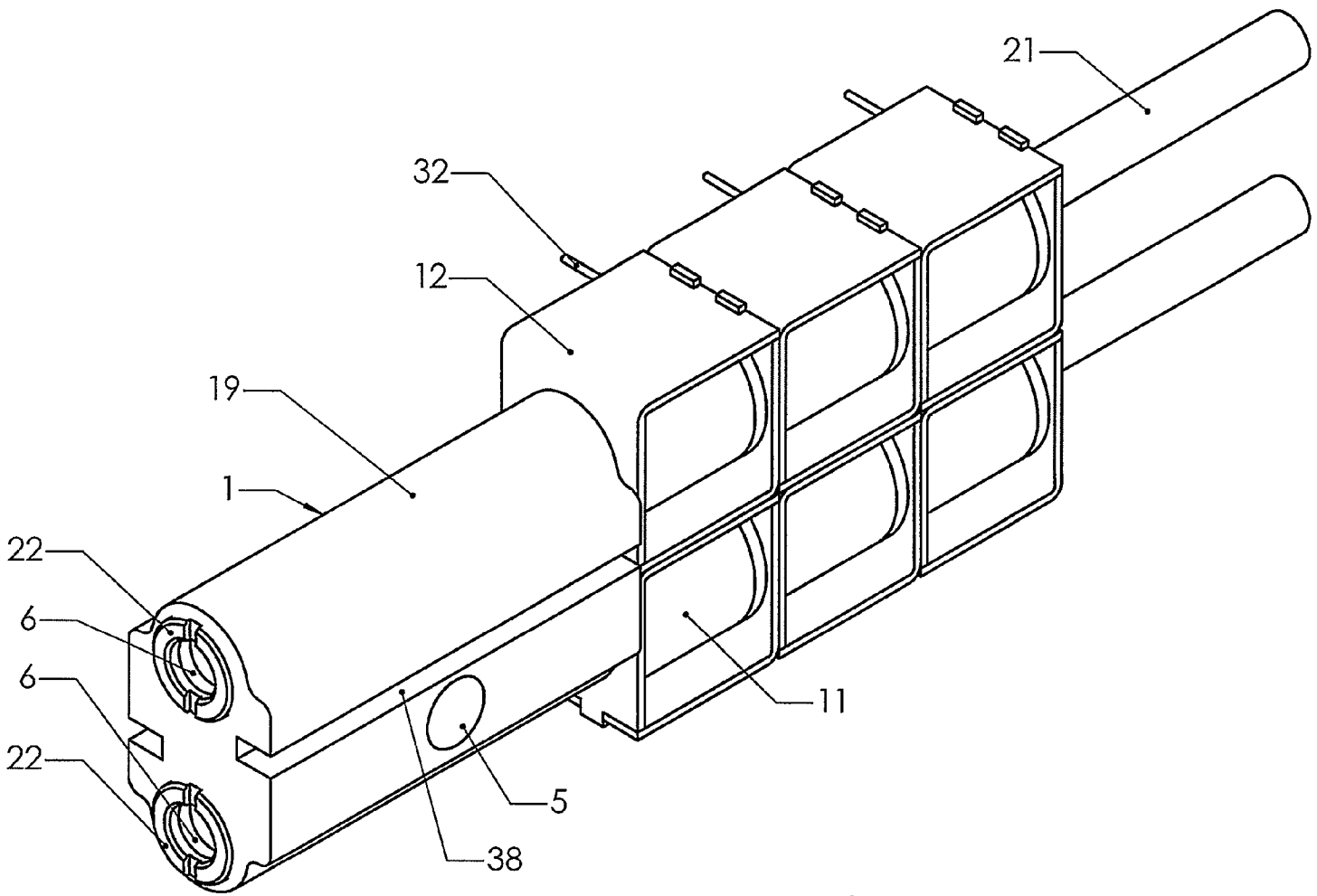
FIG. 17 shows an isometric view of two valves in accordance with the design of FIG. 14 having one body.

Another embodiment of the working prototype shown in FIG. 17 consists of two valves sharing a common housing. In this design the aperture 38 is a slot for self tapping screws. The slot is intended to assist in the mounting of the device to any intended appliance.

Figure 18:
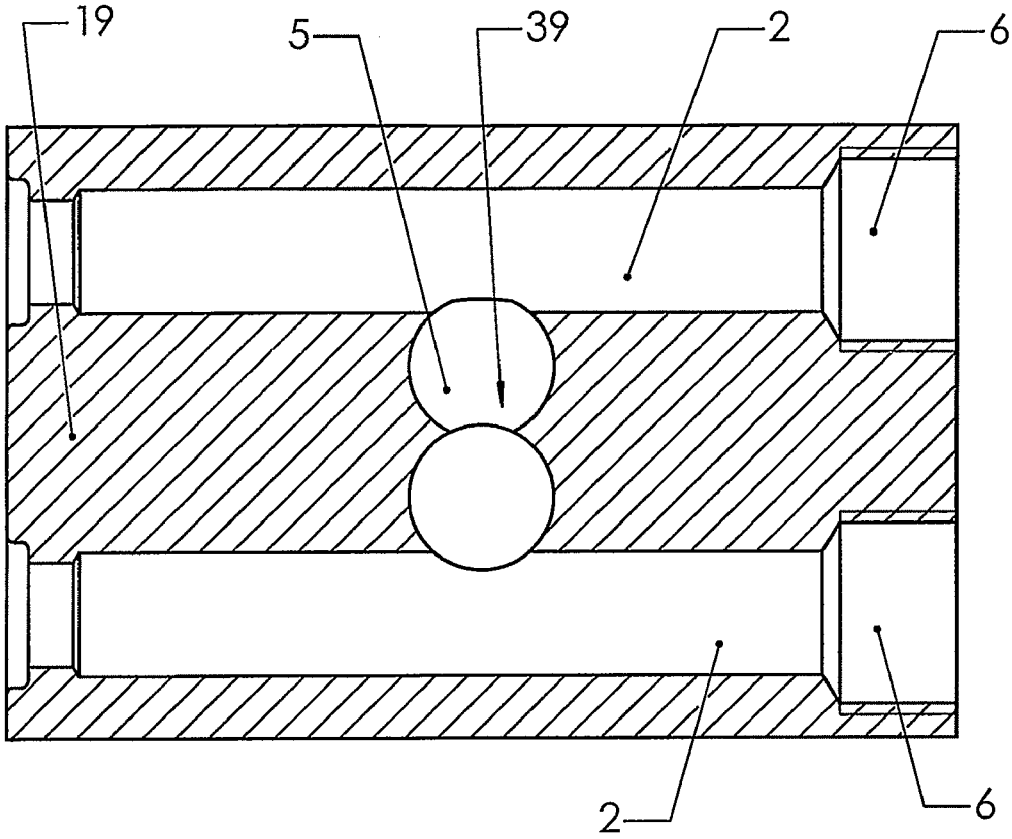
FIG. 18 shows a cross sectional view of the housing for two valves of FIG. 17.

FIG. 18 shows a cross sectional view of the housing 19 which has two chambers 2 connected to each other by two inlets 5 that are drilled from both sides of the housing. This forms a connection cavity 39. One of the inlets 5 can be blocked or sealed or used for connection to another valve.

Figure 19:
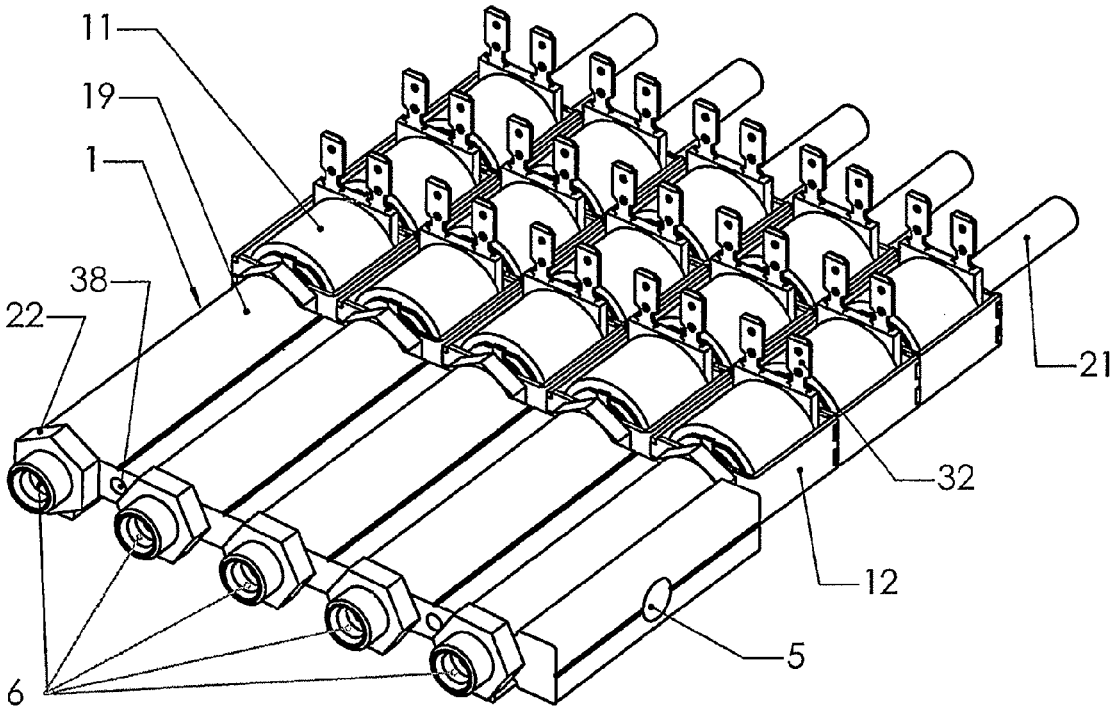
FIG. 19 shows an isometric view of five valves according to the embodiment of FIG. 14 having one body.

Another embodiment illustrated in FIG. 19 of the working prototype consists of five valves sharing a common housing.

Figure 20:
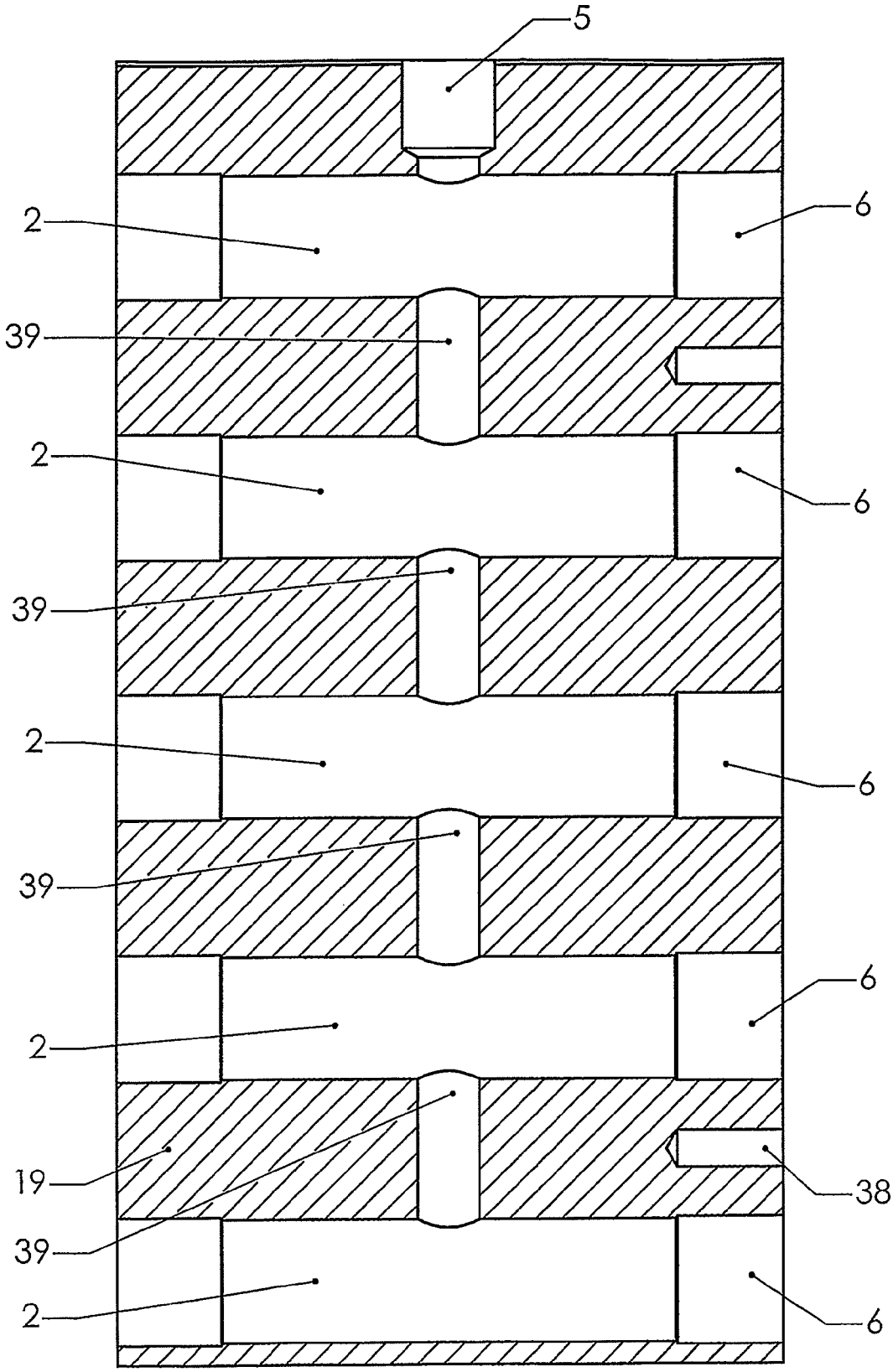
FIG. 20 shows a cross sectional view of the housing for five valves of FIG. 19.

FIG. 20 shows a cross sectional view of the housing 19 which has five chambers 2 connected to each other by a drilled hole 39.

The description above should be taken as exemplary of the invention of this application. Many different variants for example, a different number of coils and/or inlets and outlets could be used to create different flow rates or flow profiles without departing from the inventive concept as embodied in this application.

Figure 21:
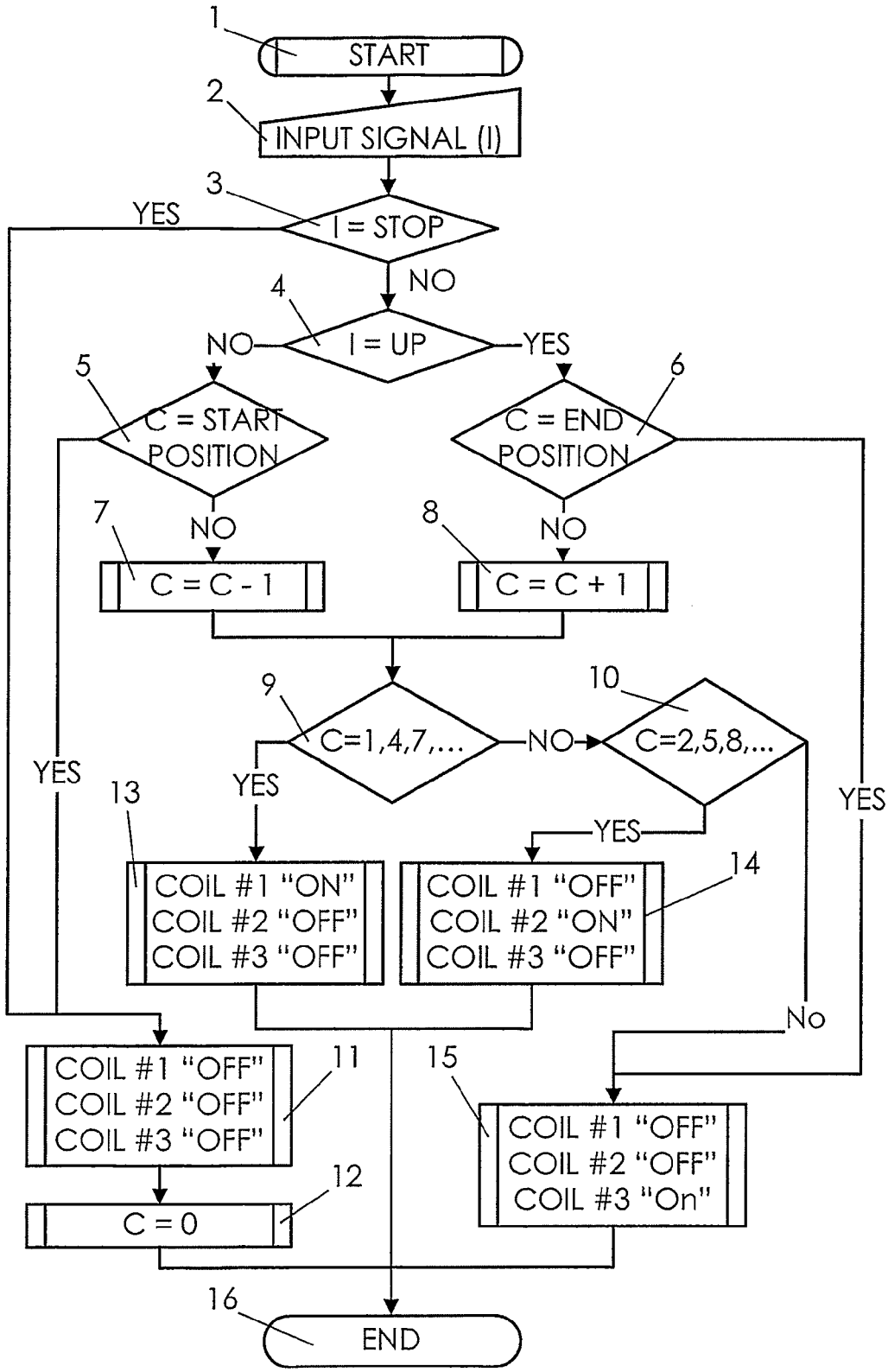
FIG. 21 shows a flow chart of a preferred embodiment of the valve operating software for controlling the valve of FIG. 14.

FIG. 21 shows a flow-chart illustrating the operational procedure of the valve. Note that this diagram describes software for a valve with three coils with a much larger number of working positions (preferably eighteen). The flow chart includes the following steps of the valve plus an OFF position:

1801. Start the procedure.

1802. Read signal "I" from operator or master controller. The signal values are "STOP"; "UP" and "DOWN".

1803. Compare signal "I" with "STOP" value. If I=STOP is true, GO TO Block 11, if–false=GO TO Block 4.

1804. Compare signal "I" with "UP" value. If I=UP is true, GO TO Block 6, if=false, GO TO the Block 5. Note that if I≠STOP or UP it means I=DOWN.

1805. Check the counter "C" value against the "Start position" which is the "Off position". If it is true, then GO TO the block 11, if false then GO TO the block 7.

1806. Check the counter "C" value against the "End position" which is the "Full On position". If it is true, then GO TO block 15 if false then GO TO the block 8.

1807. Decrease the counter value by 1.

1808. Increase the counter value by 1.

1809. Compare the counter value "C" with the sequence of positions when the coil #1 is ON (energized) which are 1, 4, 7, 10, 13, and 16.

1810. Compare the counter value "C" with the sequence of positions when the coil #2 is ON (energized) which are 2, 5, 8, 11, 14, and 17. When the "C" does not comply with conditions 9 or 10 it must be equal to a position from the sequence: 3, 6, 9, 12, 15; positions 0="Off" and 18="Full On" were checked before by the blocks 5 and 6.

1811. Disconnect all coils from the power supply.

1812. Energize coil #1 and disconnect the others.

1813. Reset the counter.

1814. Energize coil #2 and disconnect the others.

1815. Energize coil #3 and disconnect the others.

1816. End the procedure.

The described software defines forward and backward sequences and shut off operations only. Any signals from safety devices such as flame, occupancy, carbon monoxide, detectors and the like can be sent to the block 2 to shut off the valve or change its output.

Figure 22:
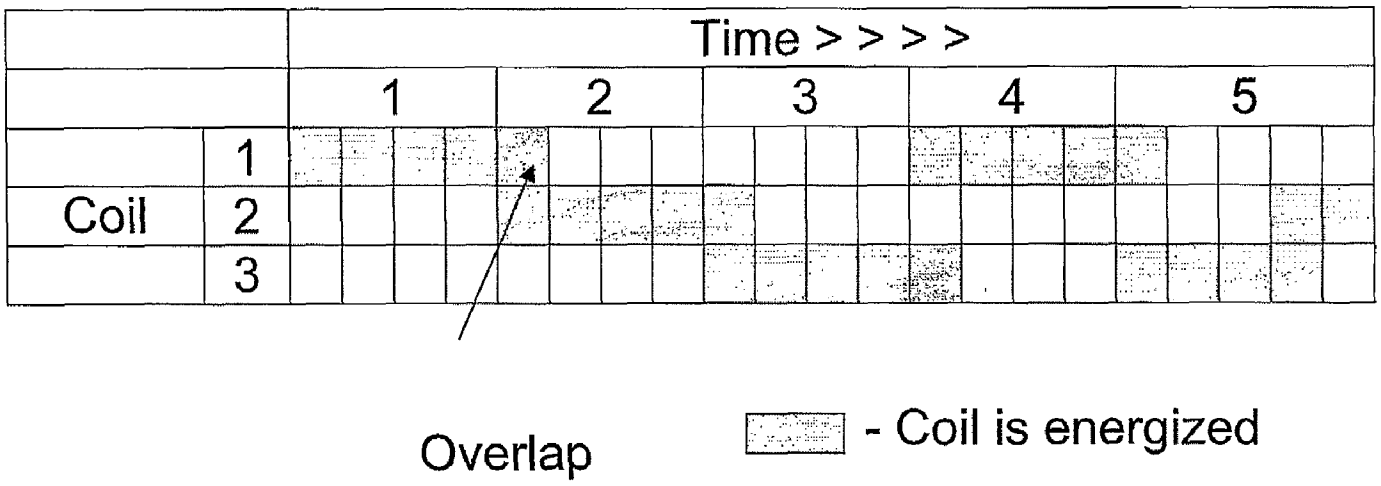
FIG. 22 shows an example of the preferred coil switching operation.

To prevent a stage loss during the switching between coils there is a period of time when two coils are energized simultaneously. This is called overlap and shown in the FIG. 22.

The force exerted by the coil on the magnetic element is greatest when the two magnetic centres 17 and 18 are aligned. To increase the transitional pull force when changing the position of the valves the coils are energized by double the voltage used to hold the magnetic element stationary inside the coil. For example the coils of working prototypes (FIGS. 14, 17 and 19) draw 4.8 W at 12V during continuous operation. This power and voltage is doubled for transitional operation (changing the stage of the valve). Note that the transitional power is only applied for a fraction of second (100-500 milliseconds) and does not harm the coils.

Figure 23:
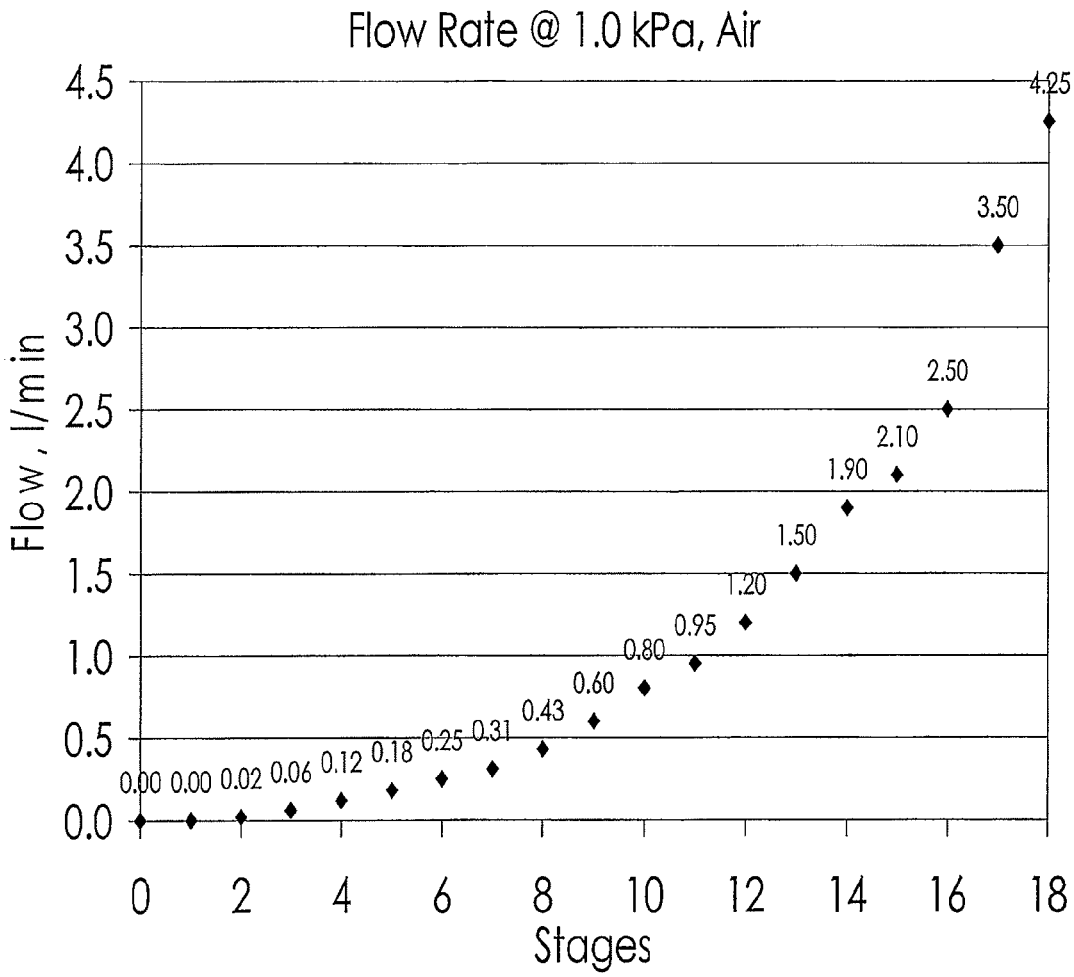
FIG. 23 shows measured air flow through the valve vs. opening stages at 1.0 kPa pressure.

FIG. 23 illustrates a rotational variant of the valve of the present. The valve includes a housing 95 that incorporates two circular plates. The valve also has an inlet 97 and an outlet 98. The first plate 90 is statically fixed and spans the entire width of the housing. This plate has a series of apertures 93 partway around a segment of the plate, at a fixed distance from the centre. These apertures 93 form the flow path of the valve. The second plate 92 also has a diameter to span the width of the housing 95. The second plate is mounted parallel to the first plate forming a seal between them. The second plate 92 has an aperture radially positioned to match the apertures in the first plate.

The second plate 92 is rotatable relative to the position of the first plate 90.

When the valve is set to stop the flow of the metered gas or fluid the aperture 91 in the rotational plate 92 will align with the segment of the fixed plate 90 without any apertures. This blocks the flow path. To start the flow of gas or fluid the plate 92 is rotated such that the aperture is aligned with the first hole in the fixed plate 90. Ideally the cross-sectional area of the first aperture in the fixed plate corresponds to the lowest desire rate of flow through the valve.

As the rotational plate is rotated further, the master aperture 91 aligns with a new selection of apertures. The series of apertures preferably incrementally increase in. The master aperture 91 may be large enough to expose all of the apertures in the valve plate simultaneously. Increasing flow rate may be provided by the number of exposed apertures progressively increasing, or by the size of the apertures progressively increasing.

The rotational valve plate is attached to a shaft which extends outside the valve housing.

The shaft can be connected to a control means which indexes the rotational position of the shaft.

The control means is ideally a rotational stepper motor 96 designed to electronically index the position of the shaft 94 thus controlling the rate of the flow through the valve.

Preferably a rotational torsion spring attached to the shaft provides an automatic return for the valve should power be inadvertently disconnected from the coils. A rotational stepper motor would hold the position of the shaft while power is applied to the coils of the motor. When the power is disconnected the holding force on the shaft is released.

Alternatively the shaft may be a hand turned control means where the shaft would incorporate a detent indexing mechanism (not shown). This method would be best suited for use with non-powered appliances such as barbeques.

Figure 24:
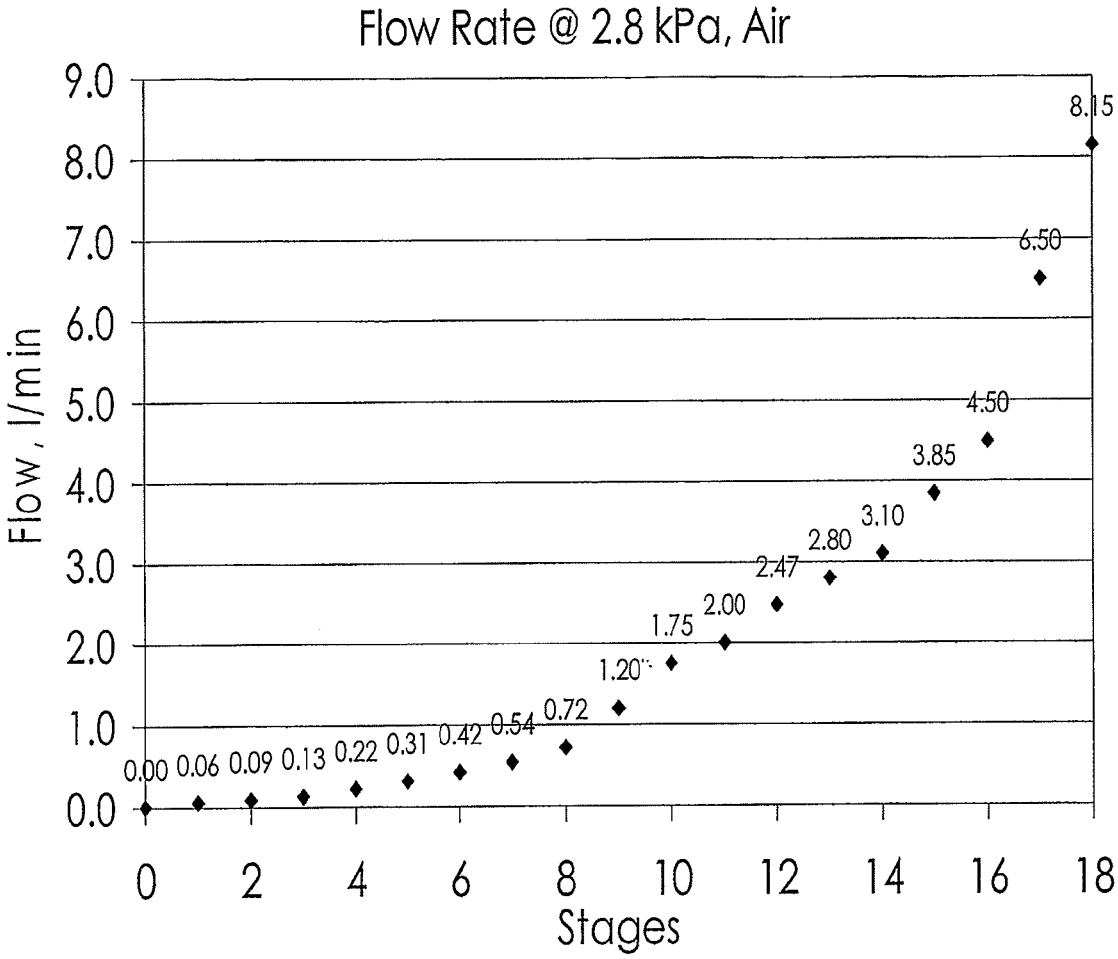
FIG. 24 shows measured air flow through the valve vs. opening stages at 2.8 kPa pressure.
Figure 25:
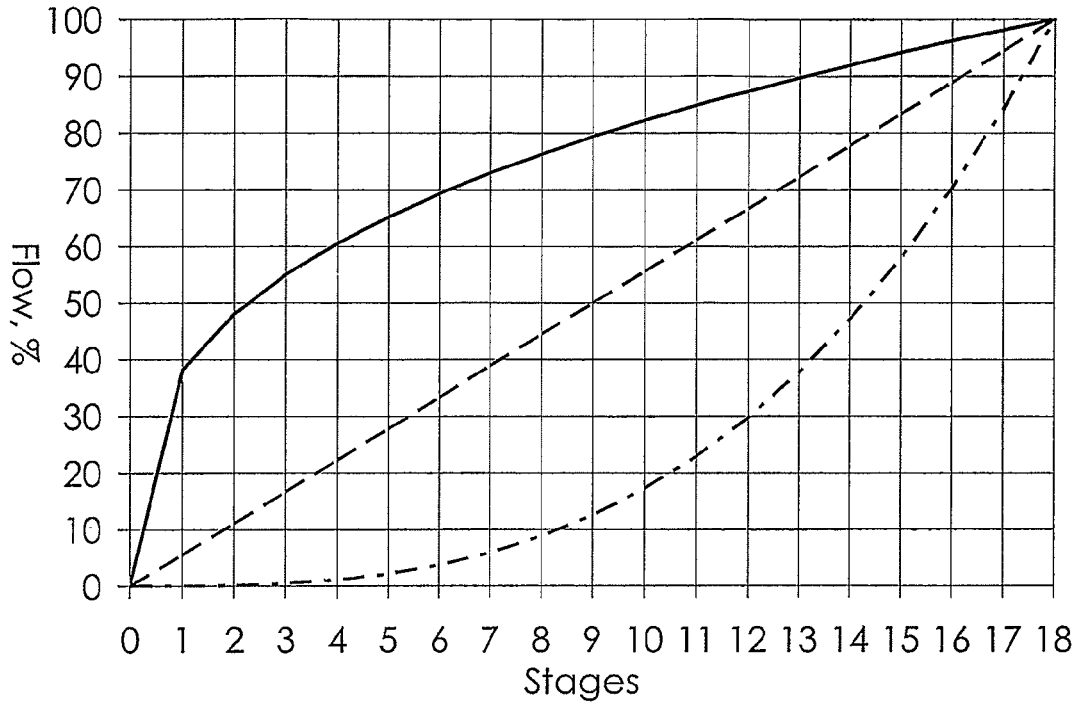
FIG. 25 shows possible output flow profiles that might be desired, and which the valve of the present invention could be made to provide.

FIGS. 23 and 24 show air flow test results of the prototype at different pressures where 1.0 kPa corresponds to mains natural gas supply and 2.8 kPa is a standard pressure for bottled LPG. The gas flow rates must be recalculated from the air output based on the relative (to air) gas viscosity and temperature. In accordance to these calculations the current prototype can supply constant burning energy from 75-750 to 16,000-31,000 BTU using Natural Gas, and from 600-6000 to 95,000-135,000 BTU using LPG. The deviations in the range depend on the quality of gases. The inlet 4 diameters are predetermined to provide a tailored flow profile. One such variation is from 0.15 mm to 1.20 mm. This arrangement has been tested in the prototype and successfully works with different sized burners providing a broad range of flame adjustment. For example the first ten stages (from 1 to 10) are used for the smallest burner and the last ten (from 9 to 18) for the biggest. Everything in between (from 4 to 13 or from 6 to 15) is used for middle size burners. This means that the valve settings can be digitally adjusted for different types of burners.

Figure 13:
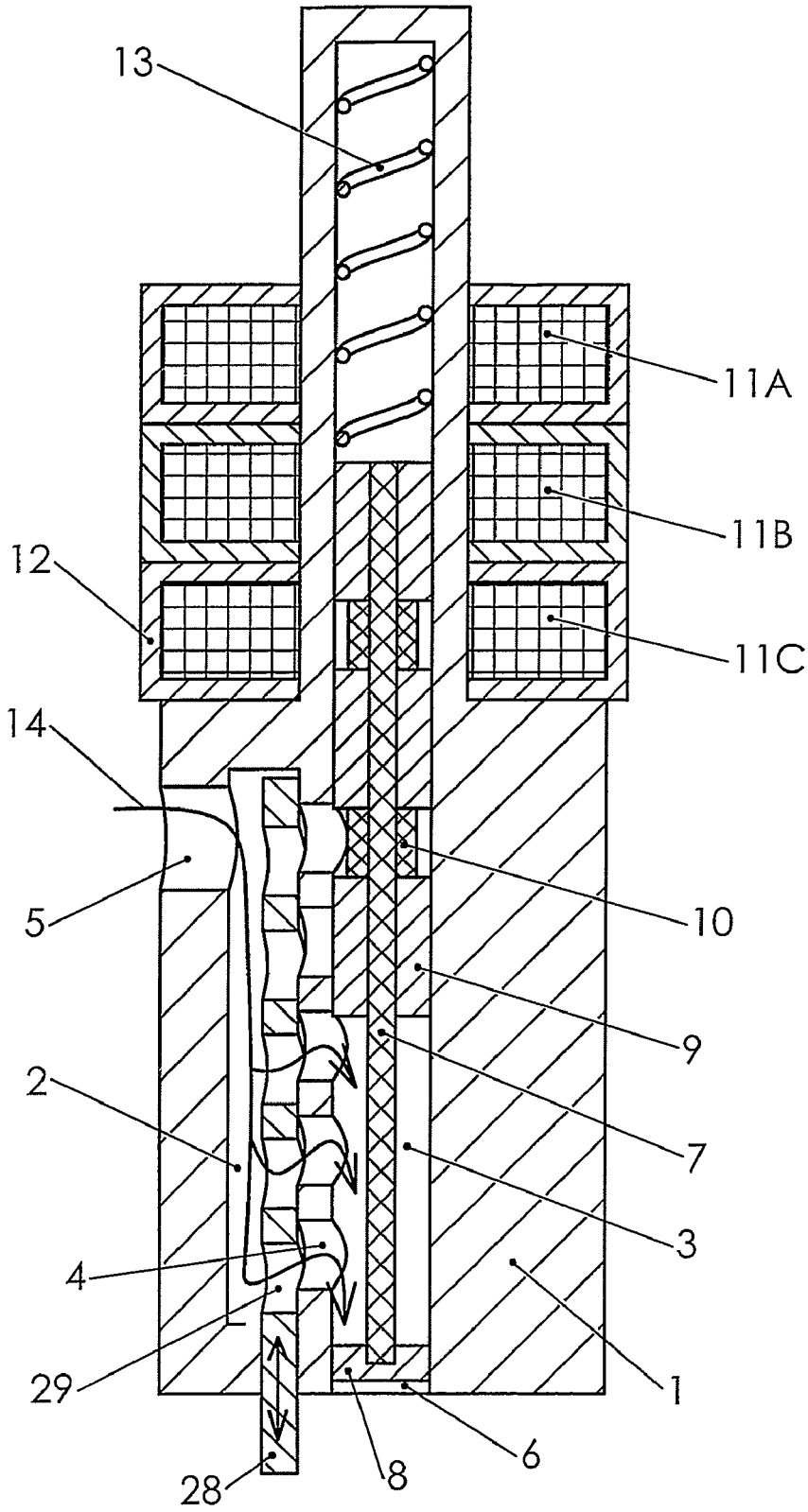
FIG. 13 shows a cross-sectional view of a valve of the present invention with a master valve between the inlet and apertures.

There are several options for manufacturing the inlets/orifices 4: high speed drilling; laser cutting; using the insertion 28 (FIG. 13) as a permanent insertion e.g. 3M high temperature aluminum foil tape 433 or 433L and punching the inlets with fine carbide wire where diameters start from 0.10 mm; and using the movable insertion 28 to adjust the overlapping cross sectional area between the inlets 4 and 29 (FIG. 13).

FIGS. 11 and 16 show piston 8 without any dynamic seal. Here piston 8 works inside a metal housing 21 and to move freely these two parts must have a clearance. This clearance causes a leakage 20 (FIG. 8). This leakage is used as a first stage of the flow.

Figure 26:
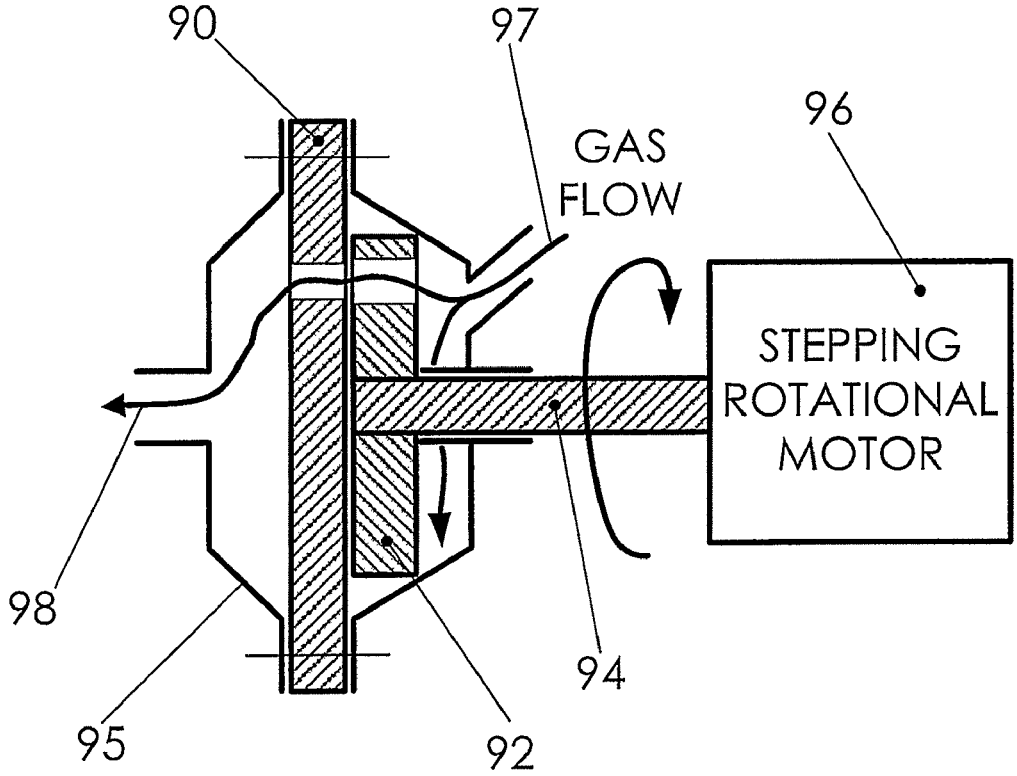
FIG. 26 shows a cross-sectional view of a rotational variant of a valve according to the present invention.
Figure 27:
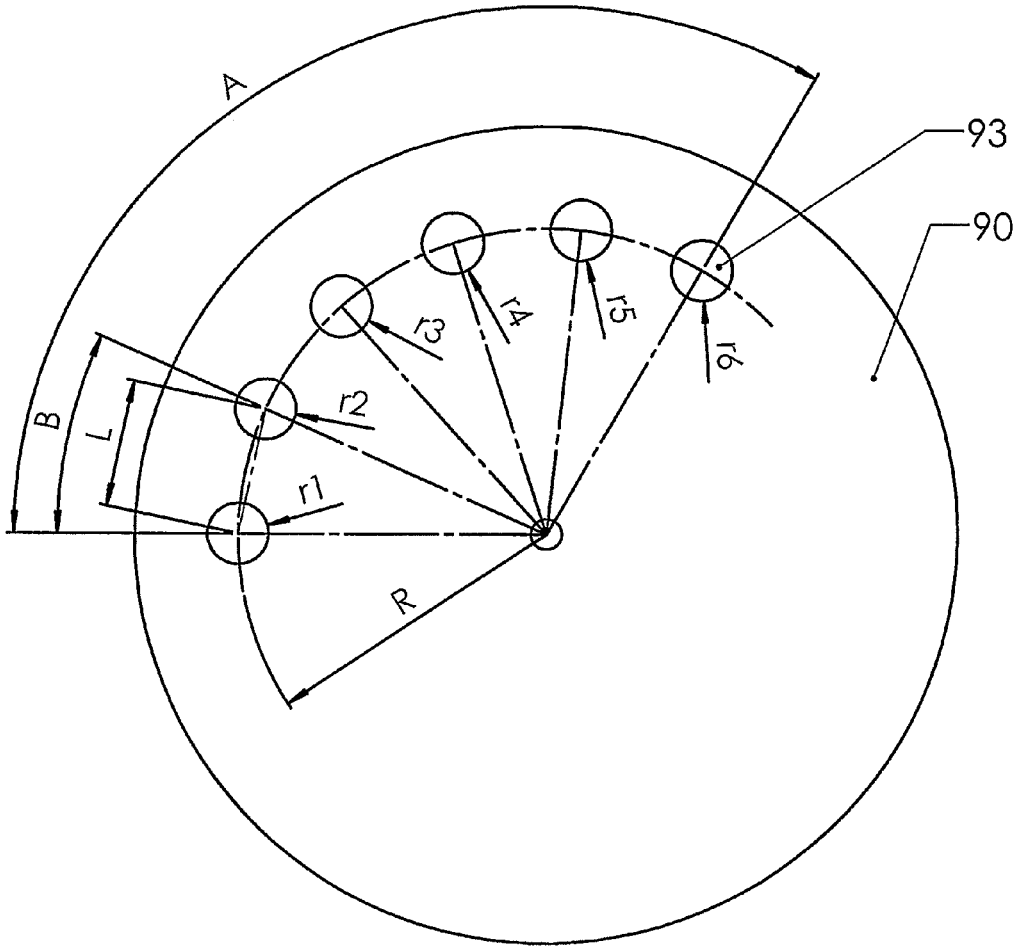
FIG. 27 illustrates the stationary plate housed within the valve for FIG. 26 having an arcuate series of apertures.
Figure 28:
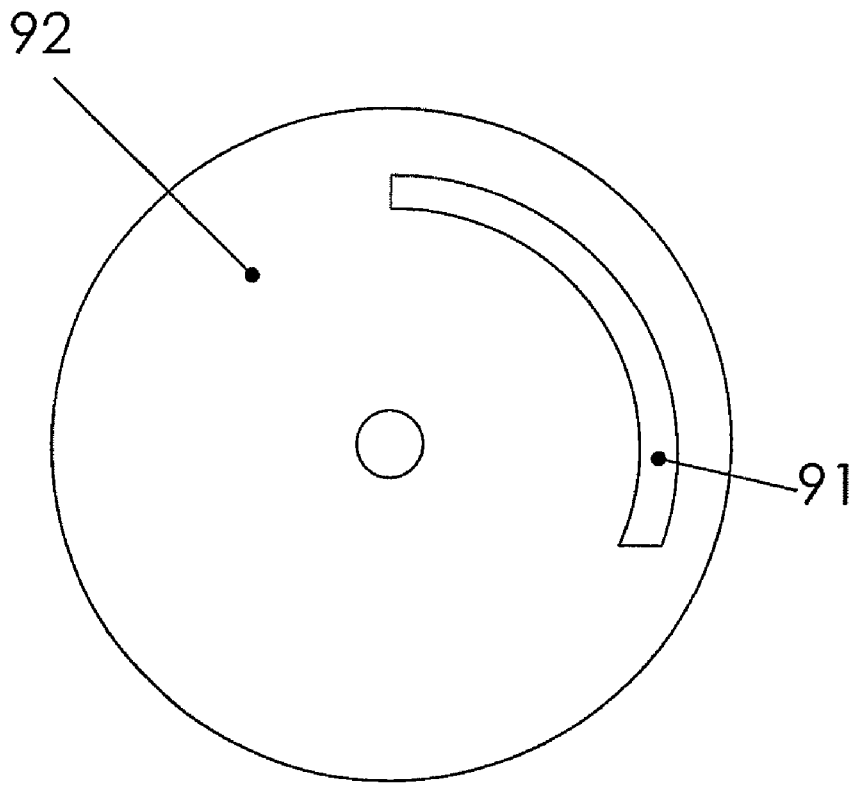
FIG. 28 illustrates an example of the valve plate in the valve of FIG. 26.

FIG. 26 shows possible flow outputs of the valve which can be continuously varied from 0 to 100%.

Figure 29:
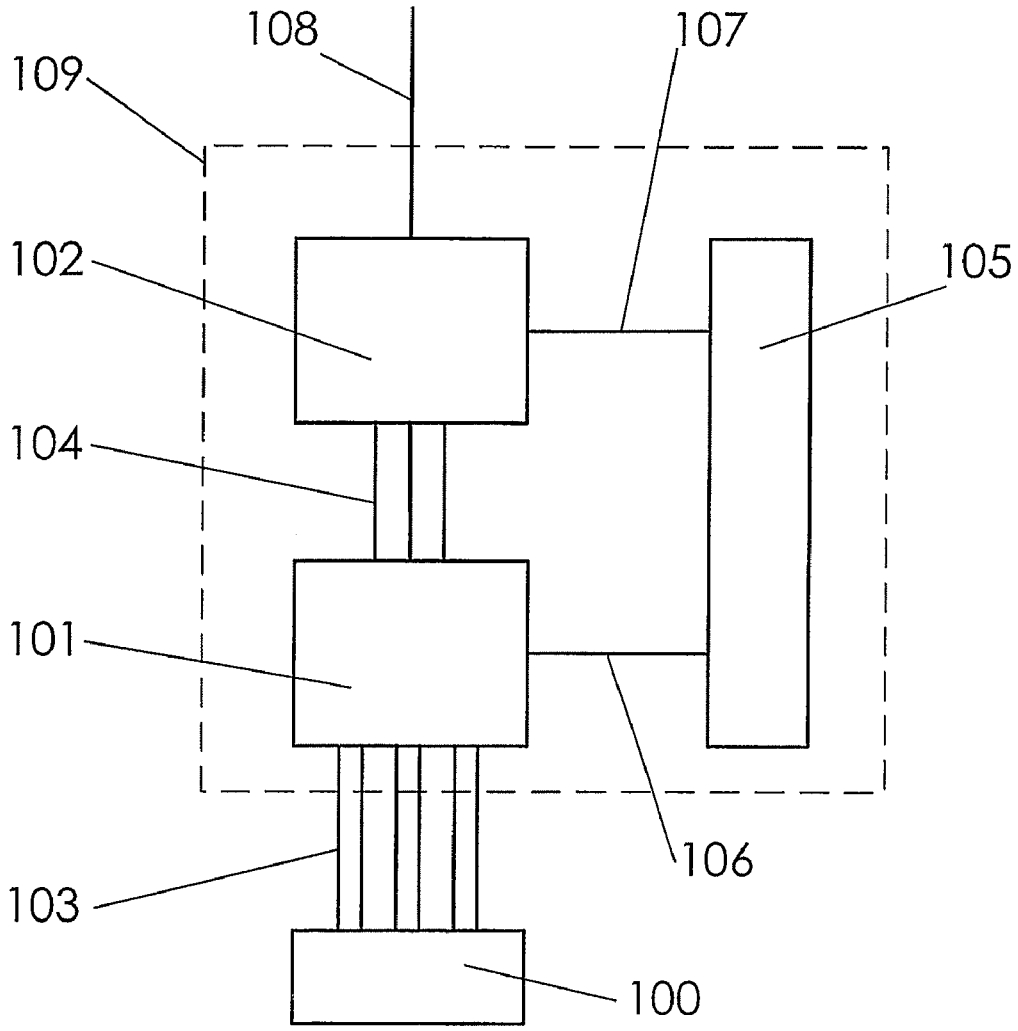
FIG. 29 is a block diagram illustrating a valve according to the present invention including control electronics.

FIG. 29 is a block diagram of the electronic modules required to operate the control valve in conjunction with the algorithm shown in FIG. 21. The control electronics receive an input signal 108 which specifies whether the valve is to be opened, closed or shut off. The microprocessor or discrete logic circuit 102 receives the input signal. In conjunction with the algorithm in FIG. 21 it generates a control signal specifying whether to apply or disconnect power from particular coils. The decision is sent to the power control module 101 via wires 104. The power control module 101 receives the control signal and amplifies it to the magnitude of power required by the coils to generate the electromotive switching force. The output of the power control module 101 is fed though wires 103 to the coils incorporated in the valve 100. A power supply unit 105 supplies a high current source to the power control module 101 through wires 106, and also supplies a low current source to the digital logic module 102 through wires 107. The control electronics are typically grouped and housed together in a working product as indicated by box 109. Alternatively the control electronics and device algorithm may be incorporated in an appliance master controller to directly apply current to the coils without an intermediate dedicated valve controller.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. For example, such alternate embodiments may include other gas appliances such as clothes dryers where the variable gas flow burner control may better regulate the drying temperature than current burner on or off systems. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A gas cook top, comprising:

a burner;

an electronically controlled variable flow gas valve interposed between the burner and an external source of gaseous fuel, the electronically controlled variable flow gas valve comprising:

a housing having an inlet port and an outlet port;

a fluid flow path between said inlet port and said outlet port;

a valve member located in said housing in said fluid flow path, said valve member moveable among a series of indexed positions;

said housing having a plurality of apertures arranged such that a varied selection of said apertures is in said fluid flow path according to the indexed position of said valve member, wherein varied selections of said apertures of each indexed position varies the flow volume permitted through the flow path via the selected one or more apertures, with no said apertures in said flow path for at least one said indexed position of said valve member;

a stepping motor fixedly connected to said valve member, said stepping motor providing for movement between a plurality of predetermined positions, said indexed positions of said valve member corresponding with the predetermined positions of the stepping motor; and wherein said apertures are provided in an axial array and said stepping motor includes a linear array of magnetic elements operating within a set of axially spaced selectively energized coils;

a capacitive touch user interface; and a controller operatively coupled to the electronically controlled variable flow gas valve and to the capacitive touch user interface, the controller being programmed to control a flame height of the burner based on input from the capacitive touch user interface.

2. The gas cook top of claim 1, wherein the capacitive touch user interface includes a flame adjust icon, and wherein the controller adjusts the electronically controlled variable flow gas valve to vary an amount of gaseous fuel flowing to the burner to control the flame height in response to a user selection of the flame adjust icon.

3. The gas cook top of claim 2, wherein the flame adjust icon has a length, and wherein the controller adjusts the electronically controlled variable flow gas valve to vary an amount of gaseous fuel flowing to the burner to control the flame height in response to a user selection of the flame adjust icon relative to its length.

4. The gas cook top of claim 1, wherein the capacitive touch user interface includes a burner select icon, and wherein the controller controls the electronically controlled variable flow gas valve to allow gaseous fuel to begin flowing to the burner to turn on the burner in response to a user selection of the burner select icon.

5. The gas cook top of claim 4, wherein the controller controls the electronically controlled variable flow gas valve to stop a flow of gaseous fuel to the burner to turn off the burner in response to a user selection of the burner select icon when the burner is on.

6. The gas cook top of claim 4, wherein the controller provides a visual indication to a user prior to controlling the electronically controlled variable flow gas valve to allow gaseous fuel to begin flowing to the burner to turn on the burner indicating that flame will soon be present.

7. The gas cook top of claim 4, wherein the controller controls the electronically controlled variable flow gas valve to allow gaseous fuel to begin flowing to the burner to turn on the burner at a lowest flame height in response to a user selection of the burner select icon.

8. The gas cook top of claim 4, wherein the controller controls the electronically controlled variable flow gas valve to allow gaseous fuel to begin flowing to the burner to turn on the burner at a previous setting of flame height in response to a user selection of the burner select icon.

9. The gas cook top of claim 1, further comprising a flame sense electrode positioned in proximity to the burner and operatively coupled to the controller, and wherein the controller is programmed to attempt to reignite the burner when the flame sense electrode senses a flame out condition.

10. The gas cook top of claim 9, wherein the controller is programmed to shut off the electronically controlled variable flow gas valve if the flame sense electrode continues to sense a flame out condition after the attempt to reignite the burner to stop a flow of gaseous fuel thereto.

11. The gas cook top of claim 1, wherein the capacitive touch user interface includes a child lockout icon, and wherein the controller is programmed to enter a lockout mode of operation to prohibit a flow of gaseous fuel to the burner in response to a user selection of the child lockout icon.

12. The gas cook top of claim 11, wherein the controller is programmed to exit the lockout mode of operation in response to the user selection of the child lockout icon for a predetermined period when the controller is in the lockout mode of operation.

13. The gas cook top of claim 1, further comprising a plurality of burners, and wherein the controller is programmed to control the flame height of each of the plurality of burners based on inputs from the capacitive touch user interface.

14. The gas cook top of claim 13, wherein the capacitive touch user interface includes an emergency burner off icon, and wherein the controller is programmed to stop a flow of gaseous fuel to all of the burners in response to a user selection of the emergency burner off icon.

15. The gas cook top of claim 13, further comprising a plurality of electronically controlled variable flow gas valves associated with the plurality of burners, wherein the capacitive touch user interface includes a plurality of burner select icons corresponding with the plurality of burners, and wherein the controller controls each of the plurality of electronically controlled variable flow gas valves to allow gaseous fuel to begin flowing to its associated burner to turn on the burner in response to a user selection of the associated burner select icon.

16. The gas cook top of claim 1, wherein the capacitive touch user interface is a glass capacitive touch user interface.

17. The gas cook top of claim 1, wherein the capacitive touch user interface includes a program setting icon, and wherein the controller adjusts the electronically controlled variable flow gas valve to vary an amount of gaseous fuel flowing to the burner to control the flame height to a programmed level in response to a user selection of the program setting icon.

18. A gas cook top, comprising:

a plurality of gaseous fuel burners;

a plurality of electronically controlled variable flow gas valves associated with the plurality of gaseous fuel burners to control an amount of gaseous fuel flowing thereto, each of the electronically controlled variable flow gas valves comprising:

a housing having an inlet port and an outlet port;

a fluid flow path between said inlet port and said outlet port;

a valve member located in said housing in said fluid flow path, said valve member moveable among a series of indexed positions;

said housing having a plurality of apertures arranged such that a varied selection of said apertures is in said fluid flow path according to the indexed position of said valve member, wherein varied selections of said apertures of each indexed position varies the flow volume permitted through the flow path via the selected one or more apertures, with no said apertures in said flow path for at least one said indexed position of said valve member;

a stepping motor fixedly connected to said valve member, said stepping motor providing for movement between a plurality of predetermined positions; said indexed positions of said valve member corresponding with the predetermined positions of the stepping motor; and wherein said apertures are provided in an axial array and said stepping motor includes a linear array of magnetic elements operating within a set of axially spaced selectively energized coils;

a capacitive touch user interface having a plurality of burner select icons and flame height adjust icons associated with each of the plurality of gaseous fuel burners; and a controller operatively coupled to the plurality of electronically controlled variable flow gas valves and to the capacitive touch user interface, the controller being programmed to control a position of each of the electronically controlled variable flow gas valves to vary the amount of gaseous fuel flowing therethrough based on input from the plurality of burner select icons and flame height adjust icons on the capacitive touch user interface.

19. The gas cook top of claim 18, further comprising a plurality of flame sense electrodes, and wherein the controller is programmed to attempt to re-establish a flame upon indication from the flame sense electrodes that a flame out condition has occurred.

20. A gas appliance, comprising:

a burner;

an electronically controlled variable flow gas valve interposed between the burner and an external source of gaseous fuel, the electronically controlled variable flow gas valve comprising:

a housing having an inlet port and an outlet port;

a fluid flow path between said inlet port and said outlet port;

a valve member located in said housing in said fluid flow path, said valve member moveable among a series of indexed positions;

said housing having a plurality of apertures arranged such that a varied selection of said apertures is in said fluid flow path according to the indexed position of said valve member, wherein varied selections of said apertures of each indexed position varies the flow volume permitted through the flow path via the selected one or more apertures, with no said apertures in said flow path for at least one said indexed position of said valve member;

a stepping motor fixedly connected to said valve member, said stepping motor providing for movement between a plurality of predetermined positions, said indexed positions of said valve member corresponding with the predetermined positions of the stepping motor; and wherein said apertures are provided in an axial array and said stepping motor includes a linear array of magnetic elements operating within a set of axially spaced selectively energized coils;

a user interface having user selectable heat settings; and a controller operatively coupled to the electronically controlled variable flow gas valve and to the user interface, the controller being programmed to control a flow of gaseous fuel to the burner based on input from the user interface of a desired heat setting.

* * * * *